US008011983B1

(12) United States Patent
Davis et al.

(10) Patent No.: US 8,011,983 B1
(45) **Date of Patent: *Sep. 6, 2011**

(54) MARINE DRIVE WITH BREAK-AWAY MOUNT

(75) Inventors: Richard A. Davis, Mequon, WI (US); David T. Creech, Glen Ellyn, IL (US); Michael P. Mihelich, Fond du Lac, WI (US); Jay Lee Cummings, Cincinnati, OH (US)

(73) Assignee: Brunswick Corporation, Lake Forest, IL (US)

( * ) Notice: Subject to any disclaimer, the term of this patent is extended or adjusted under 35 U.S.C. 154(b) by 884 days.

This patent is subject to a terminal disclaimer.

(21) Appl. No.: 11/970,132

(22) Filed: Jan. 7, 2008

(51) Int. Cl.
*B63H 5/125* (2006.01)

(52) U.S. Cl. ..... 440/56; 440/112

(58) Field of Classification Search ..... 440/52, 440/56, 112; 411/5, 389, 395; 403/2; 285/2; 52/98

See application file for complete search history.

(56) References Cited

U.S. PATENT DOCUMENTS

| | | | | |
|---|---|---|---|---|
| 1,858,582 | A | | 5/1932 | Fahrney |
| 1,890,938 | A | | 12/1932 | Fahrney |
| 1,943,288 | A | | 1/1934 | Chandler et al. |
| 2,083,054 | A | | 6/1937 | Cline |
| 2,345,689 | A | | 4/1944 | Snadecki |
| 2,393,234 | A | | 1/1946 | Burgess |
| 2,681,029 | A | | 6/1954 | Canazzi |
| 2,912,955 | A | | 11/1959 | Leipert |
| 2,917,019 | A | | 12/1959 | Krueger |
| 2,977,923 | A | | 4/1961 | Bergstedt |
| 3,628,485 | A | | 12/1971 | Gill et al. |
| 3,848,561 | A | | 11/1974 | Price |
| 3,980,035 | A | | 9/1976 | Johansson |
| 3,982,496 | A | * | 9/1976 | Blanchard ..... 440/52 |
| 4,040,378 | A | | 8/1977 | Blanchard |
| 4,087,062 | A | | 5/1978 | Masclet |
| 4,236,478 | A | | 12/1980 | Mansson |
| 4,383,828 | A | | 5/1983 | Wynne |
| 4,501,560 | A | | 2/1985 | Brandt et al. |
| 4,701,144 | A | | 10/1987 | DeWitt, III |
| 4,907,994 | A | | 3/1990 | Jones |
| 4,908,766 | A | | 3/1990 | Takeuchi |
| 5,108,325 | A | | 4/1992 | Livingston et al. |
| 5,230,644 | A | | 7/1993 | Meisenburg et al. |
| 5,277,632 | A | | 1/1994 | Davis |
| 5,301,624 | A | | 4/1994 | Hall et al. |
| 5,366,398 | A | | 11/1994 | Meisenburg et al. |

(Continued)

FOREIGN PATENT DOCUMENTS

| | | | |
|---|---|---|---|
| GB | 1264840 | A | 2/1972 |

(Continued)

OTHER PUBLICATIONS

Dec. 2004 Boating Business article entitled: *Changing Boating Forever*.

(Continued)

*Primary Examiner* — Lars A Olson

(74) *Attorney, Agent, or Firm* — Andrus, Sceales, Starke & Sawall, LLP

(57) ABSTRACT

A marine drive has a break-away mount mounting first and second sections of the drive and breaking-away in response to a given underwater impact against the second section to protect the first section and the vessel.

21 Claims, 20 Drawing Sheets

U.S. PATENT DOCUMENTS

| | | | | |
|---|---|---|---|---|
| 5,386,368 | A | 1/1995 | Knight | |
| 5,403,216 | A | 4/1995 | Salmi et al. | |
| 5,415,576 | A | 5/1995 | Meisenburg et al. | |
| 5,425,663 | A | 6/1995 | Meisenburg et al. | |
| 5,493,990 | A | 2/1996 | Dyer | |
| 5,685,253 | A | 11/1997 | Alexander, Jr. | |
| 5,735,718 | A | 4/1998 | Ekwall | |
| 5,755,605 | A | 5/1998 | Asberg | |
| 5,832,860 | A | 11/1998 | Lexau | |
| 6,038,995 | A | 3/2000 | Karafiath et al. | |
| 6,138,601 | A | 10/2000 | Anderson et al. | |
| 6,142,841 | A | 11/2000 | Alexander, Jr. et al. | |
| 6,230,642 | B1 | 5/2001 | McKenney et al. | |
| 6,234,853 | B1 | 5/2001 | Lanyi et al. | |
| 6,315,623 | B1 | 11/2001 | Hedlund | |
| 6,354,235 | B1 | 3/2002 | Davies | |
| 6,357,375 | B1 | 3/2002 | Ellis | |
| 6,386,930 | B2 | 5/2002 | Moffet | |
| 6,431,928 | B1 | 8/2002 | Aarnivuo | |
| 6,439,937 | B1 | 8/2002 | Mansson et al. | |
| 6,447,349 | B1 | 9/2002 | Fadeley et al. | |
| 6,511,354 | B1 | 1/2003 | Gonring et al. | |
| 6,544,081 | B1 | 4/2003 | Paulo | |
| 6,582,259 | B1 | 6/2003 | Mansson et al. | |
| 6,623,320 | B1 | 9/2003 | Hedlund | |
| 6,638,124 | B2 | 10/2003 | Zoubul et al. | |
| 6,688,927 | B2 | 2/2004 | Aarnivuo | |
| 6,705,907 | B1 | 3/2004 | Hedlund | |
| 6,712,654 | B1 | 3/2004 | Putaansuu | |
| 6,783,410 | B2 | 8/2004 | Florander et al. | |
| 6,863,013 | B2 | 3/2005 | Noyes, Jr. | |
| 6,942,531 | B1 | 9/2005 | Fell et al. | |
| 6,952,180 | B2 | 10/2005 | Jonsson et al. | |
| 7,182,657 | B2 * | 2/2007 | Mansson | 440/52 |
| 7,188,581 | B1 | 3/2007 | Davis et al. | |
| 7,234,983 | B2 | 6/2007 | Davis | |
| 7,294,031 | B1 | 11/2007 | Davis et al. | |
| 7,371,140 | B2 | 5/2008 | Davis | |
| 7,435,147 | B1 | 10/2008 | Eichinger | |
| 7,867,046 | B1 | 1/2011 | Eichinger | |
| 2002/0127928 | A1 | 9/2002 | Buzzi | |
| 2002/0197918 | A1 | 12/2002 | Aarnivuo | |
| 2003/0161730 | A1 | 8/2003 | Rydberg et al. | |
| 2003/0166362 | A1 | 9/2003 | Varis | |
| 2003/0236036 | A1 | 12/2003 | Varis | |
| 2004/0014380 | A1 | 1/2004 | Varis et al. | |
| 2004/0149003 | A1 | 8/2004 | Nesvall | |
| 2004/0214484 | A1 | 10/2004 | Ylitalo et al. | |
| 2005/0272321 | A1 | 12/2005 | Mansson | |

FOREIGN PATENT DOCUMENTS

| | | | |
|---|---|---|---|
| WO | 02/30740 | A1 | 4/2002 |
| WO | WO-03/042036 | | 5/2003 |
| WO | WO-03/072431 | | 9/2003 |
| WO | WO-03/074355 | | 9/2003 |
| WO | WO-03/093102 | | 11/2003 |
| WO | WO-03/093105 | | 11/2003 |
| WO | WO-03/093106 | | 11/2003 |
| WO | WO-03/093107 | | 11/2003 |
| WO | WO-2004/113162 | | 4/2004 |
| WO | WO-2004/068082 | | 8/2004 |
| WO | WO-2004/074089 | | 9/2004 |

OTHER PUBLICATIONS

Jan. 2005 Boating Magazine article by David Seidman entitled *Short Shafted*.

Marine Technology Society Dynamic Positioning Committee Conference Thrusters Session entitled Compact Azipod® Propulsion on DT Supply Vessels, presented by Strand et al., held in Oslo, Norway, Sep. 18-19, 2001.

Marine Technology Society Dynamic Positioning Committee Conference Thrusters Session entitled New Thruster Concept for Station Keeping and Electric Propulsion, presented by Adnanes et al., held in Helsinki, Finland, Sep. 18-19, 2001.

Department of Marine Technology, Norwegian University of Science and Technology, presentation entitled Dynamically Positioned and Thruster Assisted Positioned Moored Vessels, presented by Professor Asgeir J. Sorensen, held in Trondheim. Norway, 2001.

OXTS Inertial + GPS: OXTS—Oxford Technical Solutions—RT3040 (http.??oxts.com/product) last visited Sep. 30, 2005.

* cited by examiner

MARINE DRIVE WITH BREAK-AWAY MOUNT

BACKGROUND AND SUMMARY

The invention relates to marine drives and to marine vessel and drive combinations.

Marine drives as well as marine vessel and drive combinations are known in the prior art. The present invention arose during continuing development efforts directed to a marine drive for propelling a marine vessel, including a marine propulsion device extending from the vessel and having a water-engaging propulsor for propelling the vessel through a body of water, the marine drive having a first section mounted to the vessel, and a second section supporting the water-engaging propulsor for rotation. The invention also arose during continuing development efforts related to commonly owned: U.S. Pat. No. 7,188,581; U.S. Pat. No. 7,234,983; co-pending U.S. patent application Ser. No. 11/586,191, filed Oct. 25, 2006, a continuation-in-part of the '581 patent and a continuation-in-part of the '983 patent; co-pending U.S. patent application Ser. No. 11/677,720, filed Feb. 22, 2007, a continuation of the '581 patent; co-pending U.S. patent application Ser. No. 11/754,387, filed May 29, 2007, a continuation-in-part of the '983 patent; all incorporated herein by reference.

The present invention also arose during continuing development efforts directed toward marine drives and toward marine vessel and drive combinations and toward protection of the marine drive and the marine vessel upon underwater impact against the marine drive.

BRIEF DESCRIPTION OF THE DRAWINGS

FIG. 1 is a perspective view of a marine vessel and drive combination in accordance with the '983 patent.

FIG. 2 is a bottom elevation view of the combination of FIG. 1.

FIG. 3 is a side elevation view of the combination of FIG. 1.

FIG. 4 is a rear or aft elevation view of the combination of FIG. 1.

FIG. 5 is an enlarged view of a portion of FIG. 3.

FIG. 6 is an enlarged view of a portion of FIG. 2.

FIG. 7 is like FIG. 6 and shows a different steering orientation.

FIG. 8 is like FIG. 6 and shows another different steering orientation.

FIG. 9 is an enlarged view of a portion of FIG. 1.

FIG. 10 is like FIG. 9 and shows a further operational embodiment.

FIG. 11 is a side view showing the arrangement of an engine and marine propulsion device used in conjunction with the '983 patent.

FIG. 12 is an enlarged sectional view like a portion of FIG. 11 and showing the subject matter of the '191 application.

FIG. 13 is an enlarged view of a portion of FIG. 12 along line 13-13.

FIG. 14 is a perspective view of a component of FIG. 12.

FIG. 15 is a sectional view taken along line 15-15 of FIG. 14 and showing an alternate embodiment.

FIG. 16 is like FIG. 13 and shows an alternate embodiment.

DETAILED DESCRIPTION

Background Description

Figure 1:
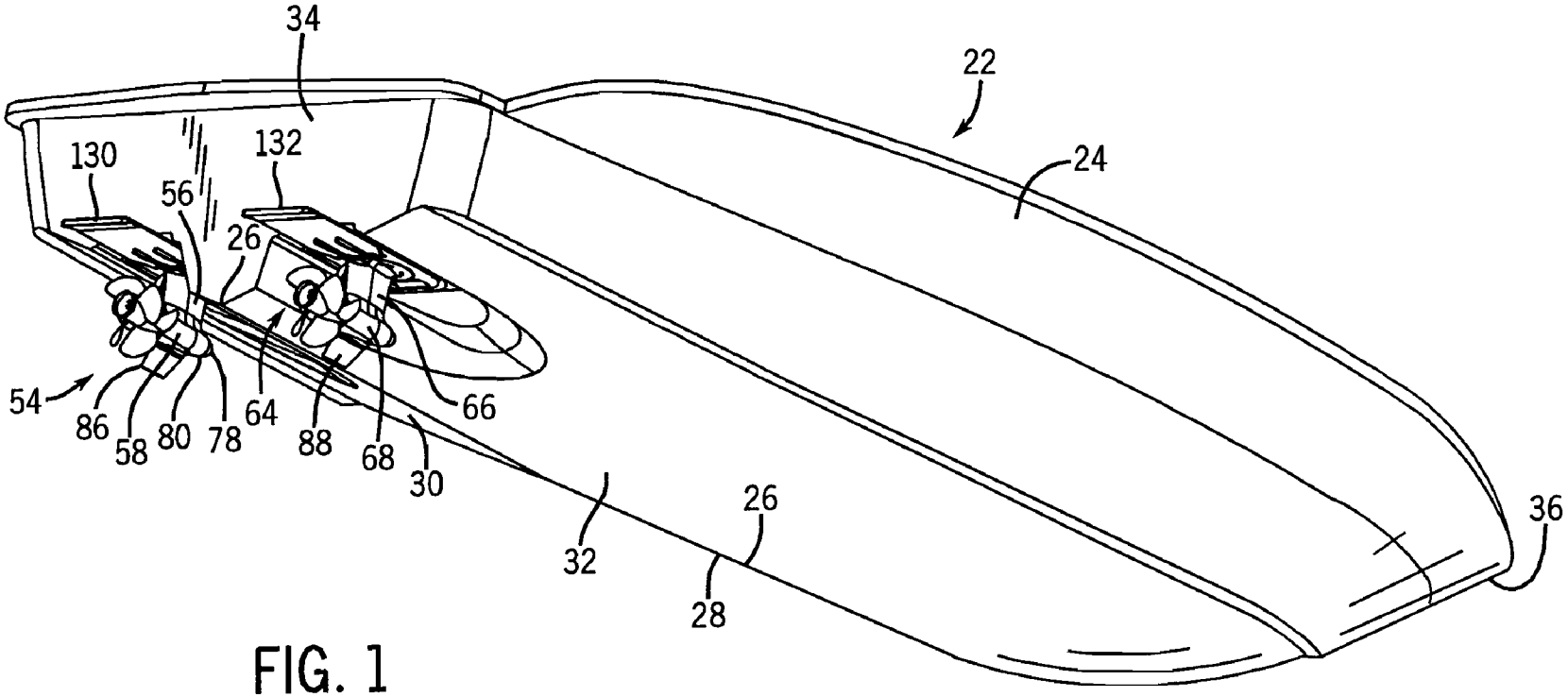
FIGS. 1-11 are taken from incorporated U.S. Pat. No. 7,234,983.

The following description of FIGS. 1-11 is taken from incorporated U.S. Pat. No. 7,234,983.

FIGS. 1-4 show a marine vessel and drive combination. Marine vessel 22 includes a hull 24 having a longitudinally extending keel 26 having a lower reach 28. The hull has port and starboard lower hull surfaces 30 and 32, respectively, extending upwardly and laterally distally oppositely from keel 26 in V-shaped relation, FIG. 4. Hull 24 extends forwardly from a stern 34 to a bow 36.

Figure 2:
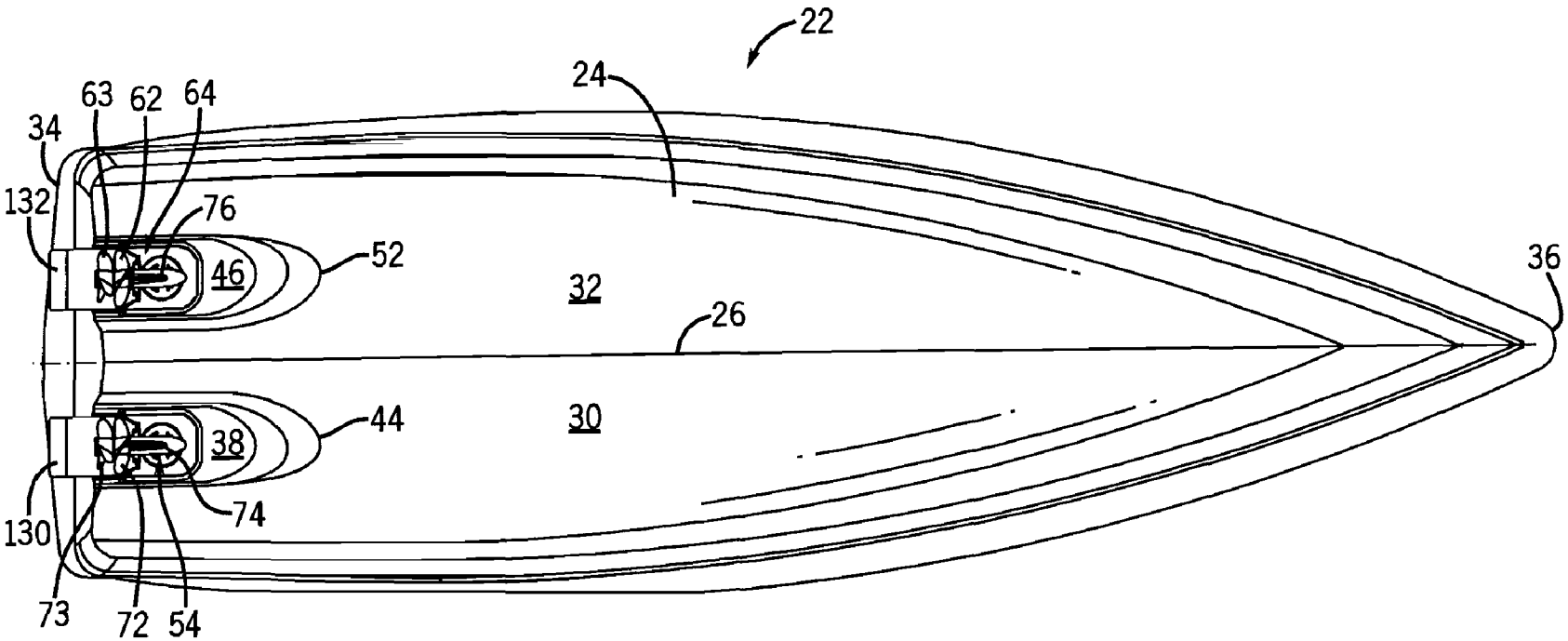
Figure 3:
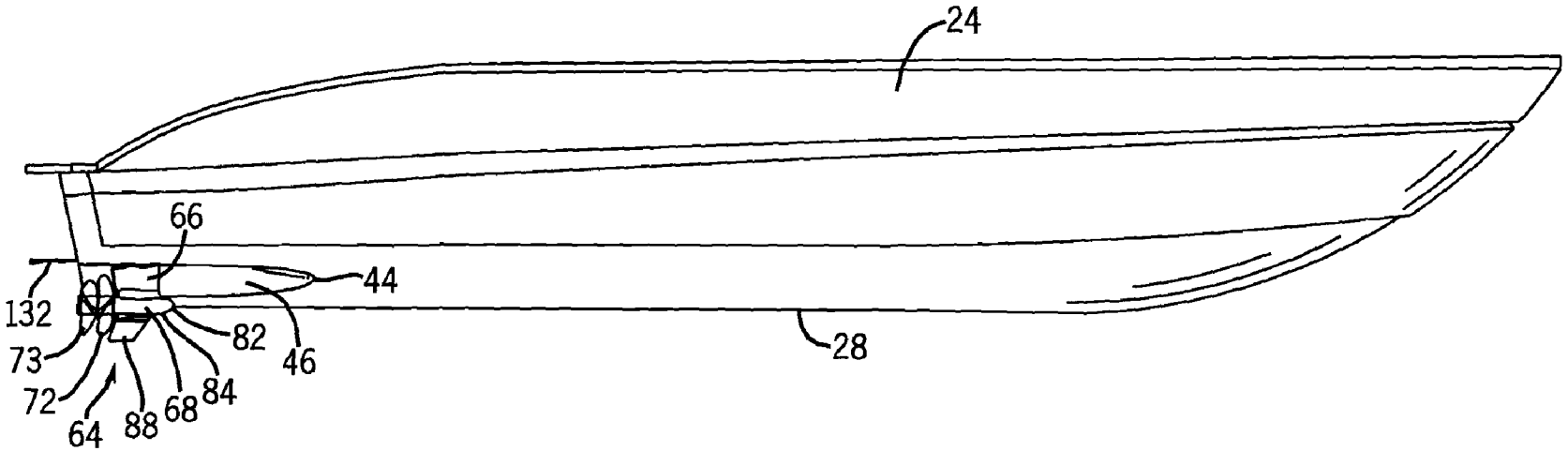

A port tunnel 38, FIG. 2, is formed in port lower hull surface 30. Port tunnel 38 has a top 40, FIG. 4, spaced above an open bottom 42 at port lower hull surface 30. Port tunnel 38 opens aft at stern 34 and extends forwardly therefrom and has a closed forward end 44 aft of bow 36. A starboard tunnel 46 is formed in starboard lower hull surface 32. Starboard tunnel 46 has a top 48 spaced above an open bottom 50 at starboard lower hull surface 32. Starboard tunnel 46 opens aft at stern 34 and extends forwardly therefrom and has a closed forward end 52 aft of bow 36.

A port marine propulsion device 54 includes a port driveshaft housing 56 extending downwardly in port tunnel 38 to a port lower gearcase 58, e.g. including a torpedo-shaped housing as is known, supporting at least one port propeller shaft 60 driving at least one water-engaging propulsor such as port propeller 62, and preferably a pair of propeller shafts driving counter-rotating propellers 62, 63, as is known, for example U.S. Pat. Nos. 5,108,325, 5,230,644, 5,366,398, 5,415,576, 5,425,663, all incorporated herein by reference. Starboard marine propulsion device 64 is comparable and includes a starboard driveshaft housing 66 extending downwardly in starboard tunnel 46 to starboard lower gearcase 68, e.g. provided by the noted torpedo-shaped housing, supporting at least one starboard propeller shaft 70 driving at least one starboard propeller 72, and preferably a pair of counter-rotating starboard propellers 72, 73, as above. The port and starboard marine propulsion devices 54 and 64 are steerable about respective port and starboard vertical steering axes 74 and 76, comparably as shown in commonly owned co-pending U.S. patent application Ser. No. 11/248,482, filed Oct. 12, 2005, and application Ser. No. 11/248,483, filed Oct. 12, 2005, incorporated herein by reference. Port steering axis 74 extends through the top 40 of port tunnel 38. Starboard steering axis 76 extends through the top 48 of starboard tunnel 46.

Figure 4:
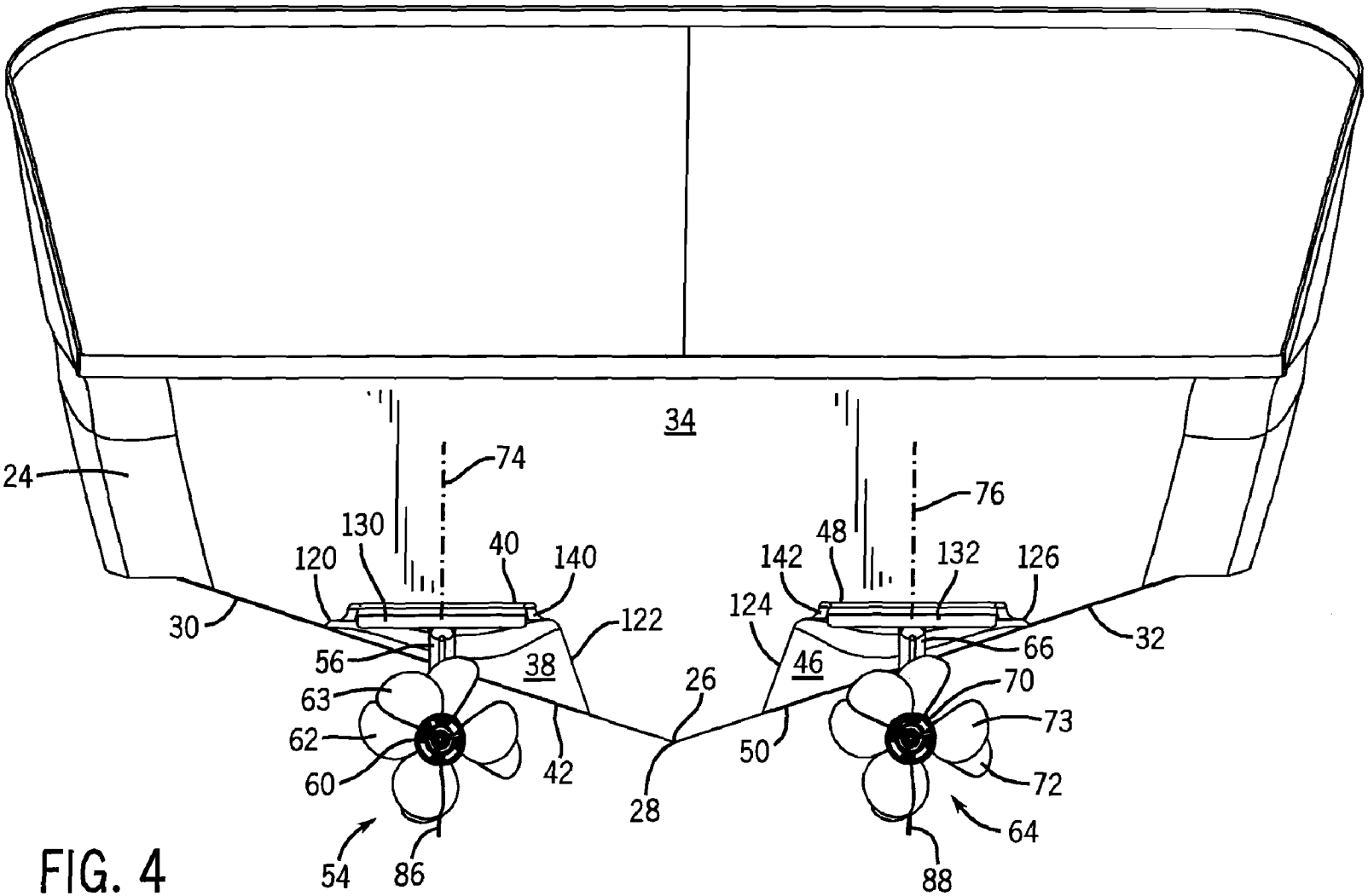
Figure 5:
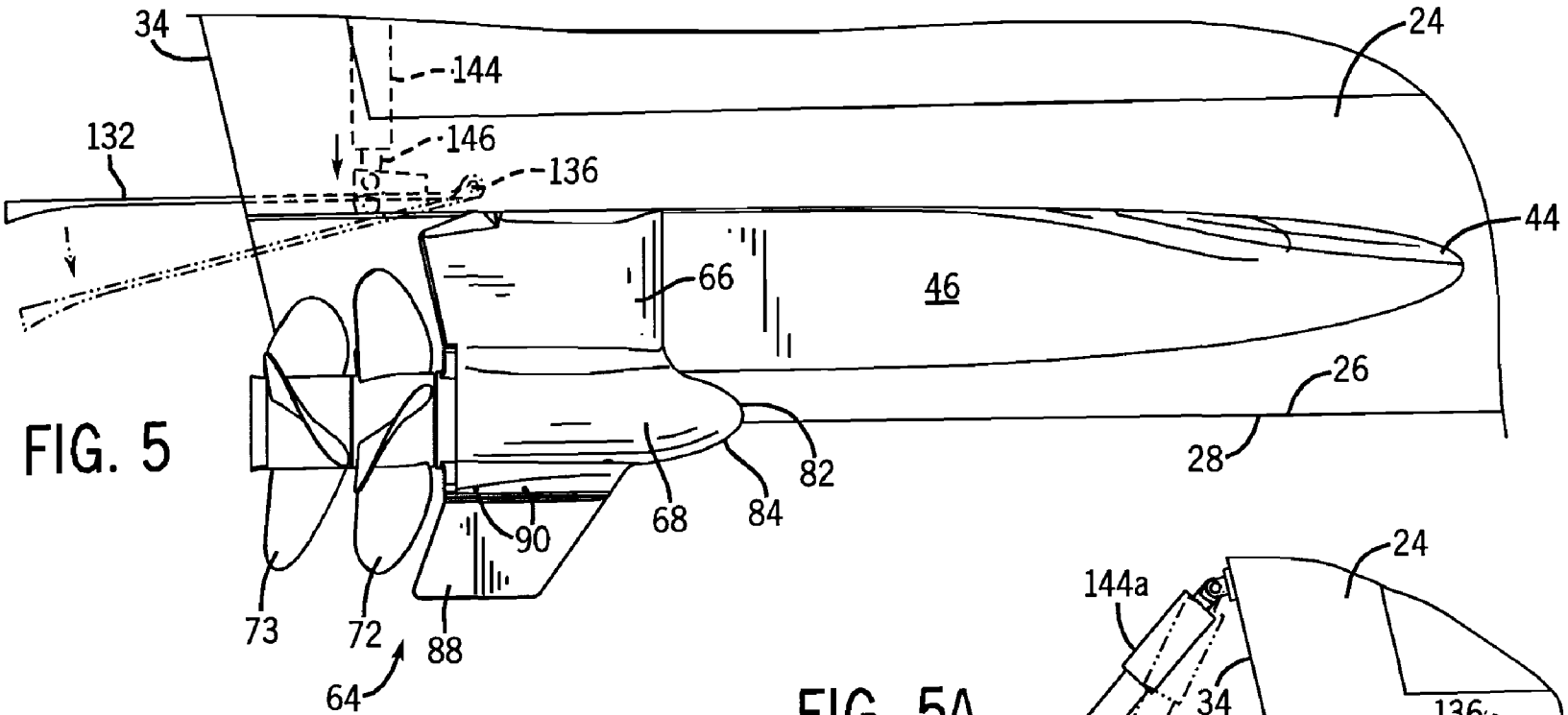
Figure 5A:
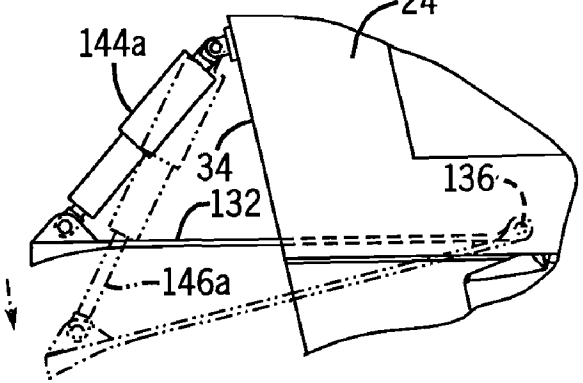
FIG. 5A is like a portion of FIG. 5 and shows an alternate embodiment.
Figure 5B:
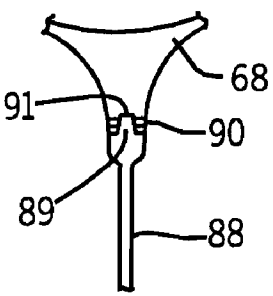
FIG. 5B is an enlarged rear elevation view of a portion of FIG. 5.

Tops 40 and 48 of port and starboard tunnels 38 and 46 are at a given vertical elevation, FIG. 4, spaced vertically above lower reach 28 of keel 26 to provide port and starboard tunnels 38 and 46 with a given vertical height receiving port and starboard marine propulsion devices 54 and 64 and raising same relative to keel 26, such that keel 26 at least partially protects port and starboard marine propulsion devices 54 and 64 from striking underwater objects, including grounding, during forward propulsion of the vessel. At least a portion of port driveshaft housing 56 is in port tunnel 38 and above open bottom 42 of port tunnel 38 at port lower hull surface 30. At least a portion of port lower gearcase 58 is outside of port tunnel 38 and below open bottom 42 of port tunnel 38 at port lower hull surface 30. At least a portion of starboard driveshaft housing 66 is in starboard tunnel 46 and above open bottom 50 of starboard tunnel 46 at starboard lower hull surface 32. At least a portion of starboard lower gearcase 68 is outside of starboard tunnel 46 and below open bottom 50 of starboard tunnel 46 at starboard lower hull surface 32. In one preferred embodiment, port and starboard lower gearcases 58 and 68 are horizontally aligned along a horizontal projection line at or above and transversely crossing lower reach 28 of keel 26. Port lower gearcase 58 includes the noted port torpedo-shaped housing having a front nose 78 with a curved surface 80 extending downwardly and aft therefrom. In one preferred embodiment, front nose 78 is horizontally aligned with lower reach 28 of keel 26, such that underwater objects struck by port lower gearcase 58 slide along curved surface 80 downwardly and aft from nose 78 of the noted port torpedo-shaped housing. Starboard lower gearcase 68 includes the noted starboard torpedo-shaped housing having a front nose 82, FIG. 5, with a curved surface 84 extending downwardly and aft therefrom. In the noted one preferred embodiment, front nose 82 is horizontally aligned with lower reach 28 of keel 26, such that underwater objects struck by starboard lower gearcase 68 slide along curved surface 84 extending downwardly and aft from nose 82 of the noted starboard torpedo-shaped housing. Further in the noted preferred embodiment, port and starboard marine propulsion devices 54 and 64 have respective port and starboard lower skegs 86 and 88 extending downwardly from respective port and starboard lower gearcases 58 and 68 to a lower reach at a vertical level below lower reach 28 of keel 26. Each of port and starboard lower skegs 86 and 88 is a breakaway skeg, e.g. mounted by frangible shear pins such as 90, FIG. 5, to its respective lower gearcase, and breaking away from its respective lower gearcase upon striking an underwater object, to protect the respective marine propulsion device. FIG. 5B is an enlarged rear elevation view of a portion of skeg 88 and gearcase 68 of FIG. 5, with propellers 72 and 73 removed, and showing the mounting of skeg 88 to lower gearcase 68 by a breakaway channel or tongue and groove arrangement, for example tongue 89 at the top of skeg 88, and groove or channel 91 at the bottom of lower gearcase 68 receiving tongue 89 in breakaway manner upon shearing of frangible pins such as 90.

Figure 6:
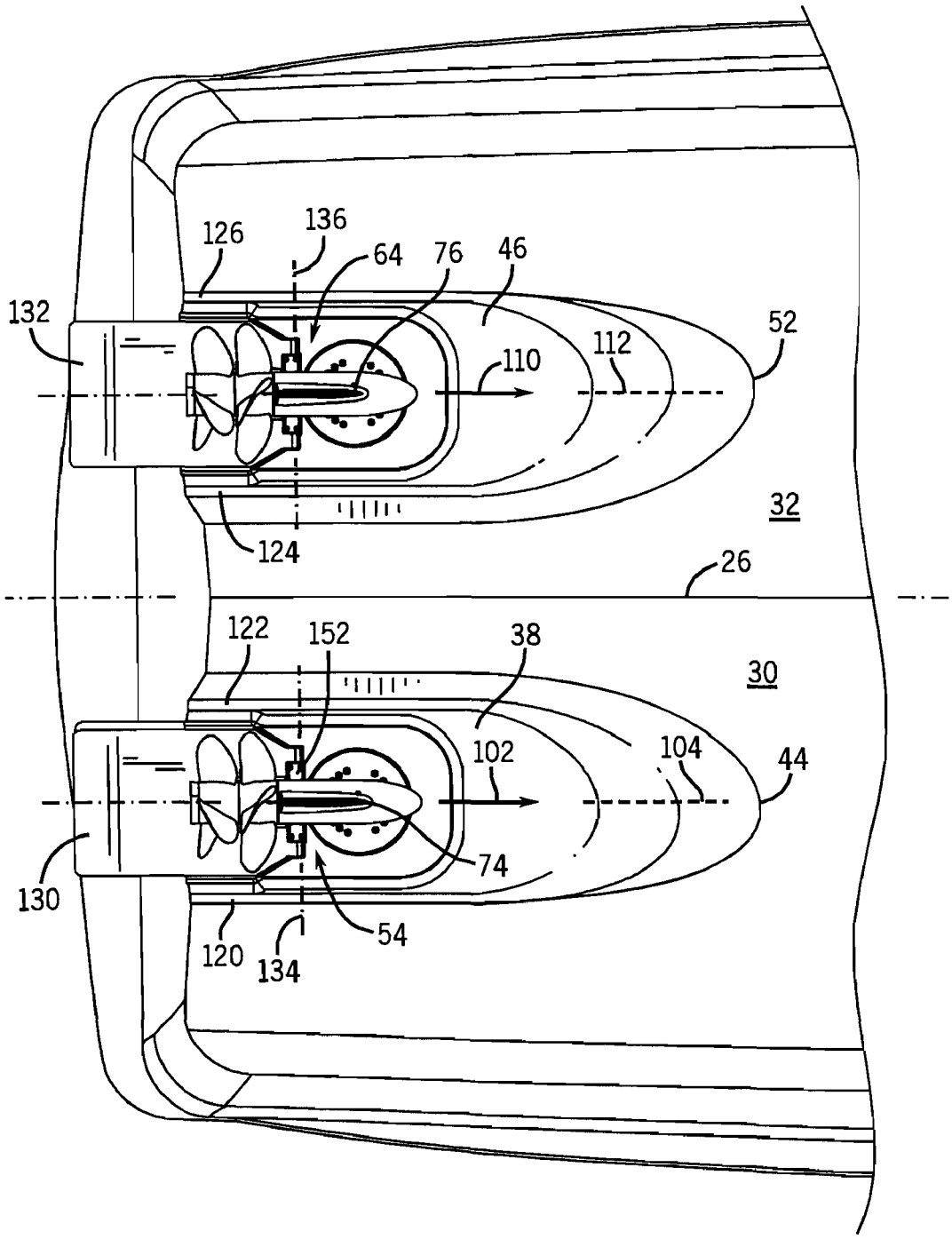
Figure 7:
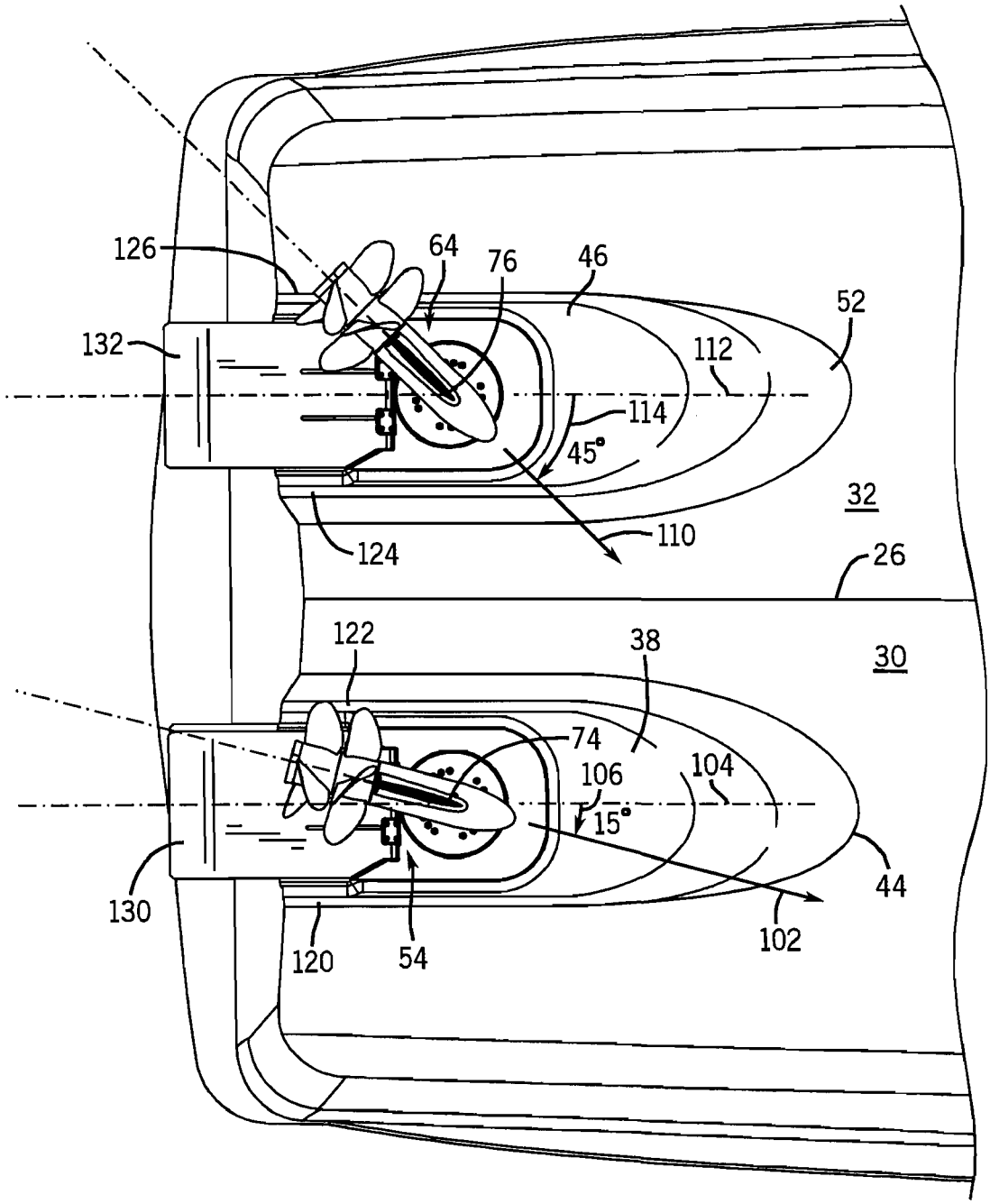
Figure 8:
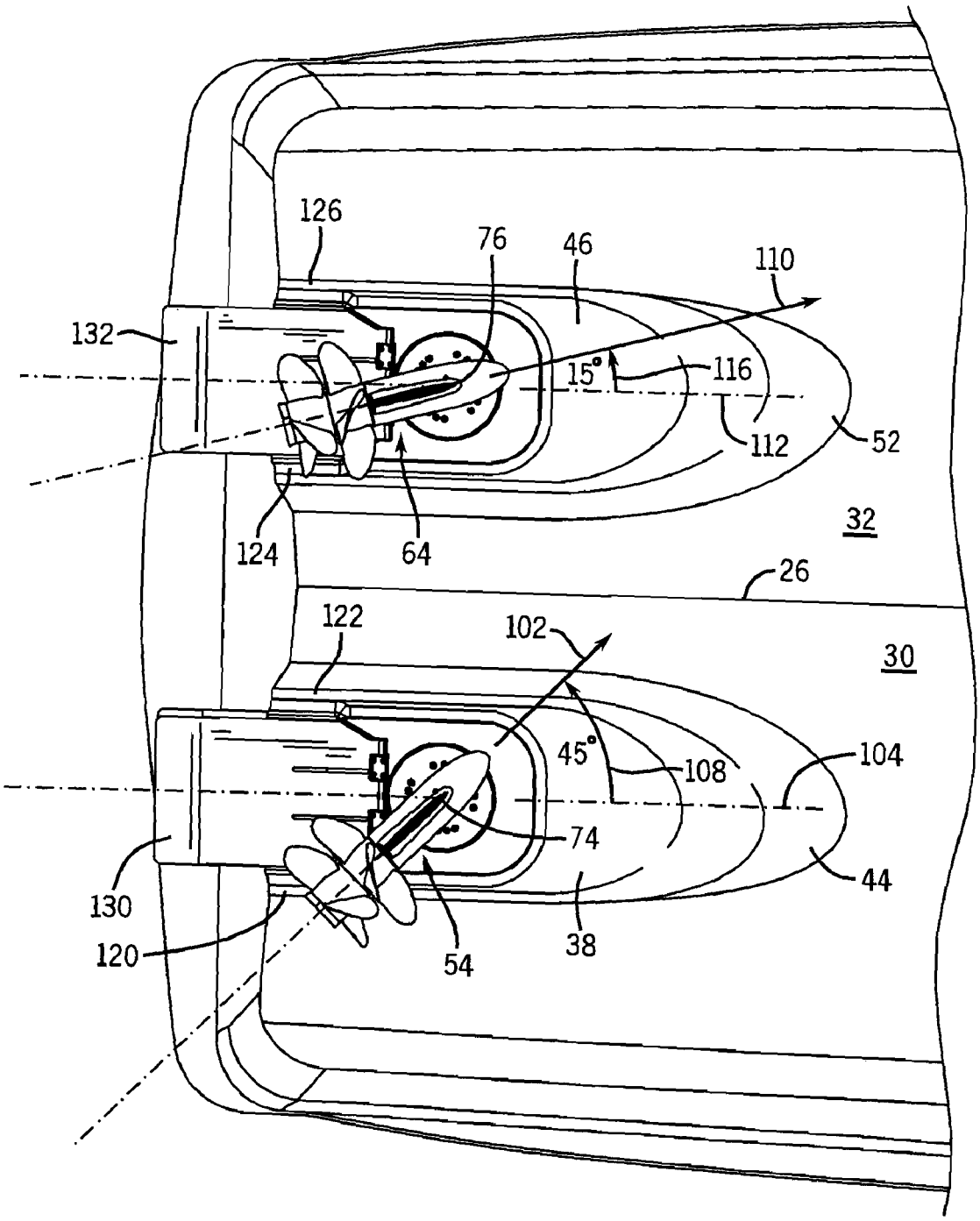
Figure 9:
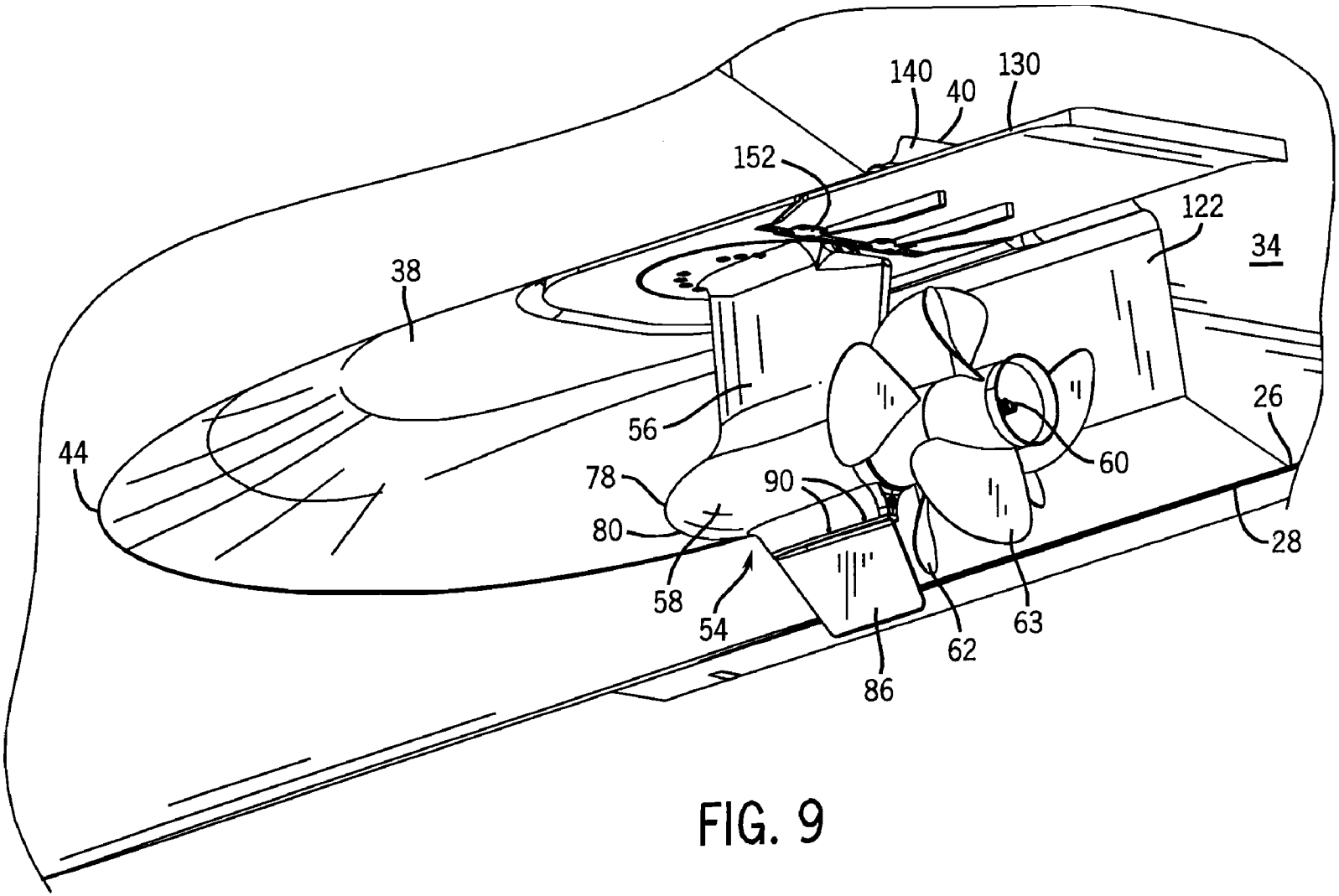
Figure 10:
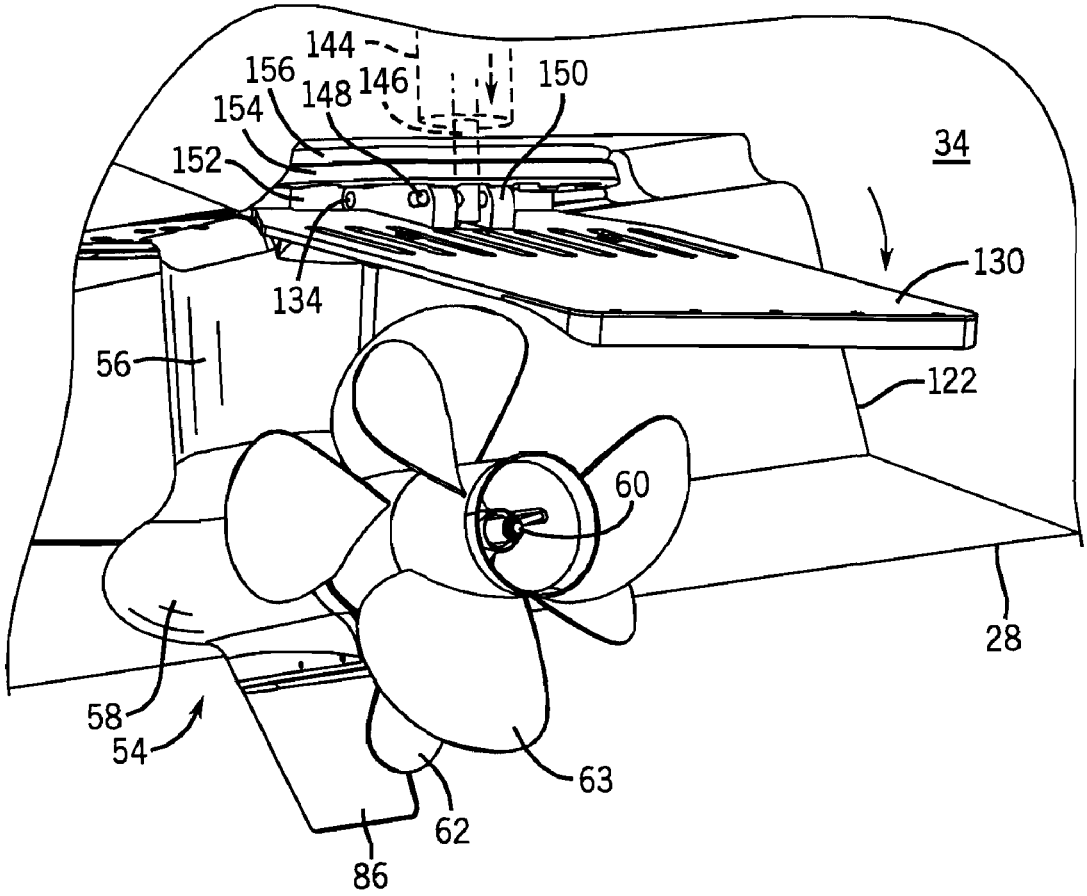

Port marine propulsion device 54 provides propulsion thrust along a port thrust direction 102, FIG. 6, along the noted at least one port propeller shaft 60. Port marine propulsion device 54 has a port reference position 104 with port thrust direction 102 pointing forwardly parallel to keel 26. Port marine propulsion device 54 is steerable about port steering axis 74 along a first angular range 106, FIG. 7, from port reference position 104 away from keel 26, e.g. clockwise in FIG. 7. Port marine propulsion device 54 is steerable about steering axis 72 along a second angular range 108, FIG. 8, from port reference position 104 towards keel 26, e.g. counterclockwise in FIG. 8. Angular ranges 106 and 108 are unequal, and port tunnel 38 is asymmetric, to be described. Starboard propulsion device 64 provides propulsion thrust along a starboard thrust direction 110 along the noted at least one starboard propeller shaft 70. Starboard marine propulsion device 64 has a starboard reference position 112, FIG. 6, with starboard thrust direction 110 pointing forwardly parallel to keel 26. Starboard marine propulsion device 64 is steerable about starboard steering axis 76 along a third angular range 114, FIG. 7, from starboard reference position 112 towards keel 26, e.g. clockwise in FIG. 7. Starboard marine propulsion device 64 is steerable about starboard steering axis 76 along a fourth angular range 116, FIG. 8, away from keel 26, e.g. counterclockwise in FIG. 8. Third and fourth angular ranges 114 and 116 are unequal, and starboard tunnel 46 is asymmetric, to be described. In one preferred embodiment, second angular range 108 is at least twice as great as first angular range 106, and in a further preferred embodiment, first angular range 106 is at least 15 degrees, and second angular range 108 is at least 45 degrees. In the noted preferred embodiment, third angular range 114 is at least twice as great as fourth angular range 116, and in the noted further preferred embodiment, third angular range 114 is at least 45 degrees, and fourth angular range 116 is at least 15 degrees. Marine propulsion devices 54 and 64 may be rotated and steered in unison with equal angular ranges, or may be independently controlled for various steering, docking, and position or station maintaining virtual anchoring functions, and for which further reference is made to the above-noted commonly owned co-pending '482 and '483 applications.

Port tunnel 38 has left and right port tunnel sidewalls 120 and 122 extending vertically between top 40 of port tunnel 38 and open bottom 42 of port tunnel 38 and port lower hull surface 30. Left and right port tunnel sidewalls 120 and 122 are laterally spaced by port driveshaft housing 56 therebetween. Right port tunnel sidewall 122 has a greater vertical height and a lower vertical reach than left port tunnel sidewall 120 and limits the span of first angular range 106 to be less than the span of second angular range 108. Starboard tunnel 46 has left and right starboard tunnel sidewalls 124 and 126 extending vertically between top 48 of starboard tunnel 46 and open bottom 50 of starboard tunnel 46 at starboard lower hull surface 32. Left and right starboard tunnel sidewalls 124 and 126 are laterally spaced by starboard driveshaft housing 66 therebetween. Left starboard tunnel sidewall 124 has a greater vertical height and a lower vertical reach than right starboard tunnel sidewall 126 and limits the span of fourth angular range 116 to be less than the span of third angular range 114.

Port marine propulsion device 54 has a port trim tab 130 pivotally mounted thereto for contact by the water for adjusting vessel attitude and/or altering thrust vectors or otherwise affecting hydrodynamic operation of the vessel. Starboard marine propulsion device 64 has a starboard trim tab 132 pivotally mounted thereto. Port trim tab 130 is preferably pivotally mounted to port marine propulsion device 54 at a pivot axis 134, FIG. 6, aft of port driveshaft housing 56 and aft of port steering axis 74. Likewise, starboard trim tab 132 is preferably pivotally mounted to starboard marine propulsion device 64 at a pivot axis 136 aft of starboard driveshaft housing 66 and aft of starboard steering axis 76. Port trim tab 130 has an upwardly pivoted retracted position, FIGS. 1, 4, 9, and solid line in FIG. 5, and a downwardly pivoted extended position, FIG. 10, and dashed line in FIG. 5. The top 40, FIG. 4, of port tunnel 38 has a notch 140 receiving port trim tab 130 in the noted retracted position to enhance hydrodynamic profile by providing a smoother transition providing less restriction to water flow therepast. Starboard trim tab 132 likewise has an upwardly pivoted retracted position, and a downwardly pivoted extended position. The top 48 of starboard tunnel 46 has a notch 142 receiving starboard trim tab 132 in the noted retracted position to enhance hydrodynamic profile.

Each trim tab may be actuated in conventional manner, e.g. hydraulically, e.g. by a hydraulic cylinder 144 having an extensible and retractable plunger or piston 146 engaging pivot pin 148 journaled to stanchions 150 of the respective trim tab. In an alternate embodiment, FIG. 5A, external hydraulic cylinder 144*a* has its piston 146*a* connected to the aft end of the trim tab, for a longer moment atm from the pivot axis of the trim tab if desired. In further embodiments, the trim tabs may be actuated electrically, e.g. by electrical reduction motors. The forward end of the trim tab is pivotally mounted at hinges such as 152 to mounting plate 154 of the marine propulsion device which is then mounted to the vessel hull and sealed thereto for example at sealing gasket 156. In the preferred embodiment, the forward end of the trim tab is pivotally mounted to the marine propulsion device and not to the vessel, and the aft end of the trim tab is movable in a vertical arc.

Figure 11:
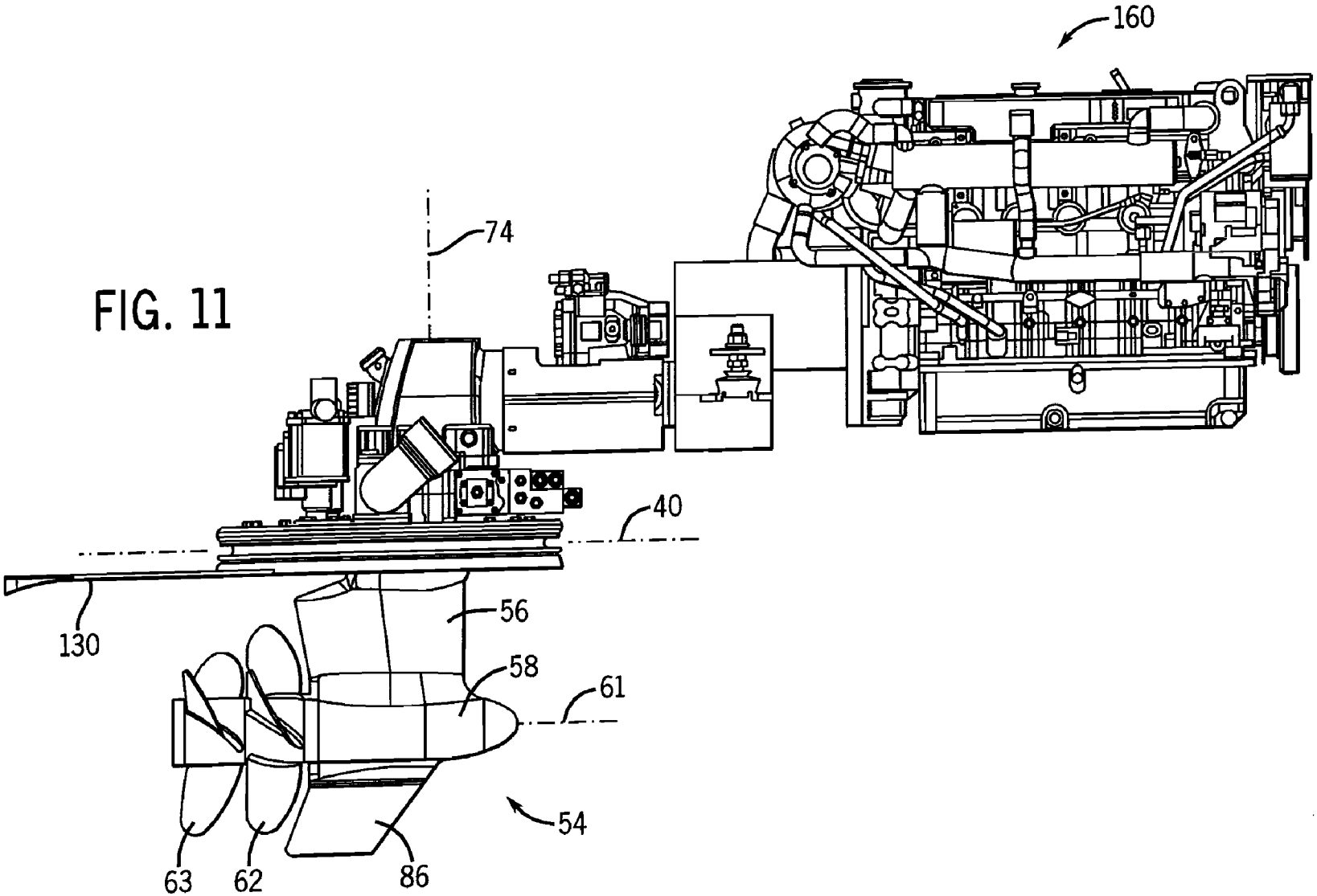

FIG. 11 is a side view taken from the above-noted commonly owned co-pending '482 and '483 applications and showing the arrangement of a marine propulsion device, such as 54 or 64, associated with a mechanism that is able to rotate the marine propulsion device about its respective steering axis 74 or 76. Although not visible in FIG. 11, the driveshaft of the marine propulsion device extends vertically and parallel to the steering axis and is connected in torque transmitting relation with a generally horizontal propeller shaft that is able to rotate about a propeller axis 61. The embodiment shown in FIG. 11 comprises two propellers 62 and 63, as above noted, that are attached to the propeller shaft 60. The motive force to drive the propellers 62 and 63 is provided by an internal combustion engine 160 that is located within the bilge of the marine vessel 22. The engine is configured with its crankshaft aligned for rotation about a horizontal axis. In one preferred embodiment, engine 160 is a diesel engine. Each of the two marine propulsion devices 54 and 64 is driven by a separate engine 160. In addition, each of the marine propulsion devices 54 and 64 are independently steerable about their respective steering axes 74 and 76. The steering axes are generally vertical and parallel to each other. They are intentionally not configured to be perpendicular to the bottom respective surface 30 and 32 of the hull. Instead, they are generally vertical and intersect the respective bottom surface 30 and 32 of the hull at an angle that is not equal to 90 degrees when the bottom surface of the hull is a V-type hull or any other shape which does not include a flat bottom. Driveshaft housings 56 and 66 and gearcase torpedo housings 58 and 68 contain rotatable shafts, gears, and bearings which support the shafts and connect the driveshaft to the propeller shaft for rotation of the propellers. No source of motive power is located below the hull surface. The power necessary to rotate the propellers is solely provided by the internal combustion engine. The marine vessel maneuvering system in one preferred embodiment is that provided in the noted commonly owned co-pending '482 and '483 applications, allowing the operator of the marine vessel to provide maneuvering commands to a microprocessor which controls the steering movements and thrust magnitudes of two marine propulsion devices 54, 64 to implement those maneuvering commands, e.g. steering, docking, and position or station maintaining virtual anchoring functions, and the like, as above noted.

The following description of FIGS. 12-16 is taken from incorporated commonly owned co-pending U.S. patent application Ser. No. 11/586,191, filed Oct. 25, 2006, and uses like reference numerals from above where appropriate to facilitate understanding.

As noted above, the marine vessel and drive combination includes marine vessel 22, FIG. 1, having a hull 24 having a longitudinally extending keel 26 with port and starboard lower hull surfaces 30 and 32, respectively, extending upwardly and laterally distally oppositely from keel 26 in V-shaped relation, FIG. 4. Hull 24 extends forwardly from a stern 34 to a bow 36. Port and starboard tunnels 38 and 46, respectively, are formed in the port and starboard lower hull surfaces 30 and 32, respectively. Port tunnel 38 has a top 40, FIG. 4, spaced above an open bottom 42 at port lower hull surface 30. Port tunnel 38 opens aft at stern 34 and extends forwardly therefrom and has a closed forward end 44 aft of bow 36. Starboard tunnel 46 has a top 48 spaced above an open bottom 50 at starboard lower hull surface 32. Starboard tunnel 46 opens aft at stern 34 and extends forwardly therefrom and has a closed forward end 52 aft of bow 36. Port and starboard marine propulsion devices 54 and 64, respectively, extend downwardly in respective port and starboard tunnels 38 and 46 through respective tops 40 and 48 of port and starboard tunnels 38 and 46 through respective openings therein, one of which is shown in FIG. 12 at 162 which is an opening extending through the hull at top 40 of port tunnel 38 formed in port lower hull surface 30.

Figure 12:
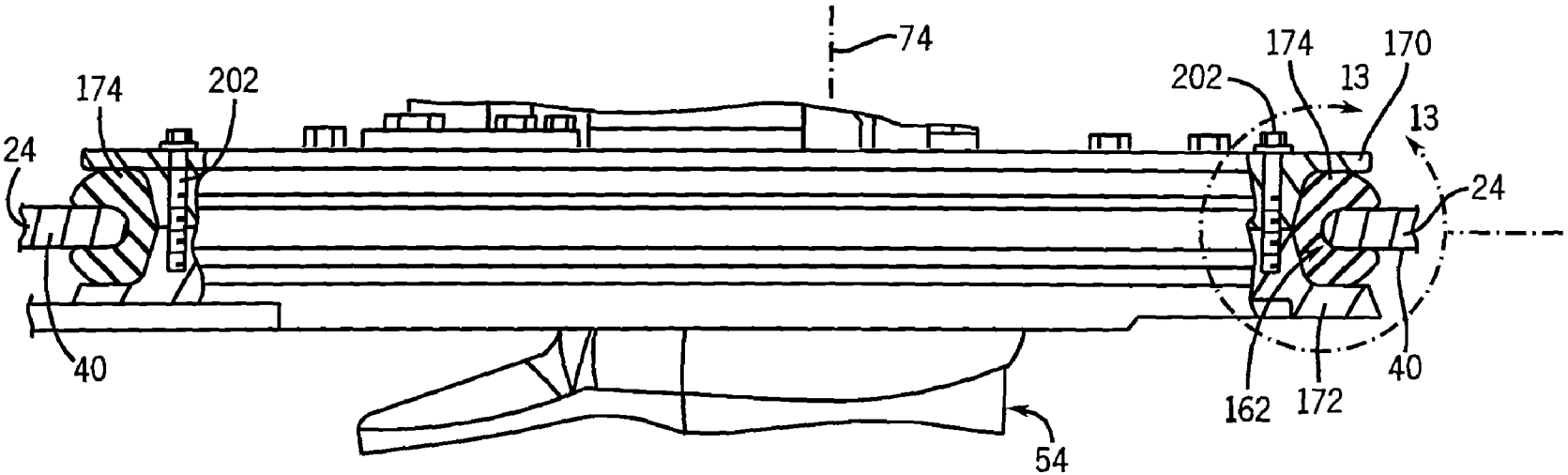
FIGS. 12-16 are taken from the noted incorporated commonly owned co-pending U.S. patent application Ser. No. 11/586,191, filed Oct. 25, 2006.
Figure 13:
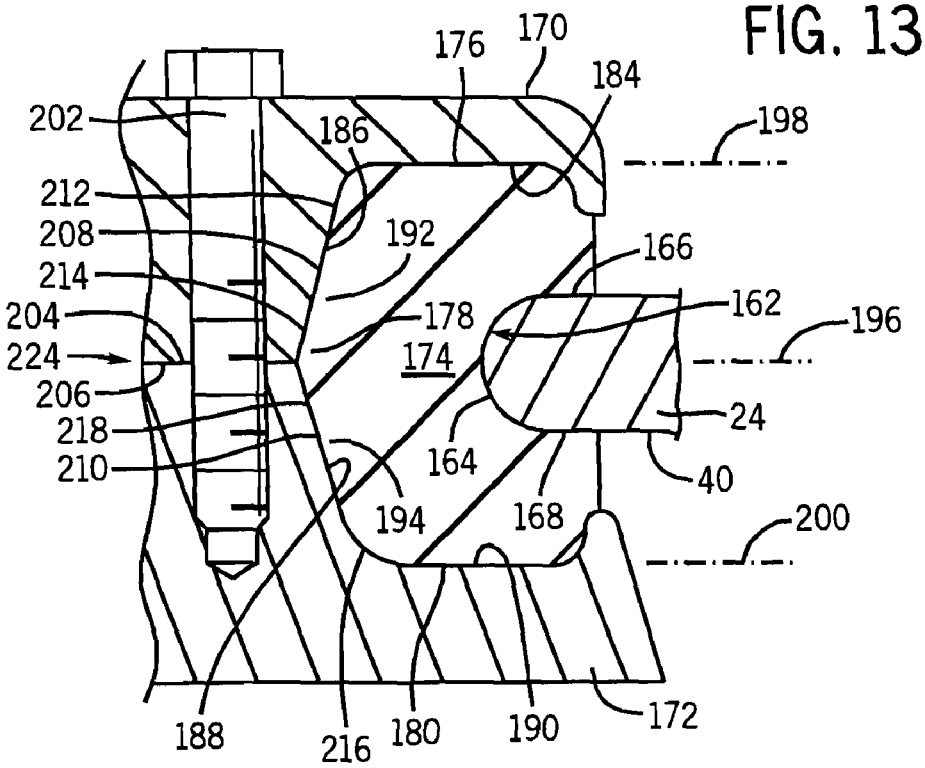
Figure 14:
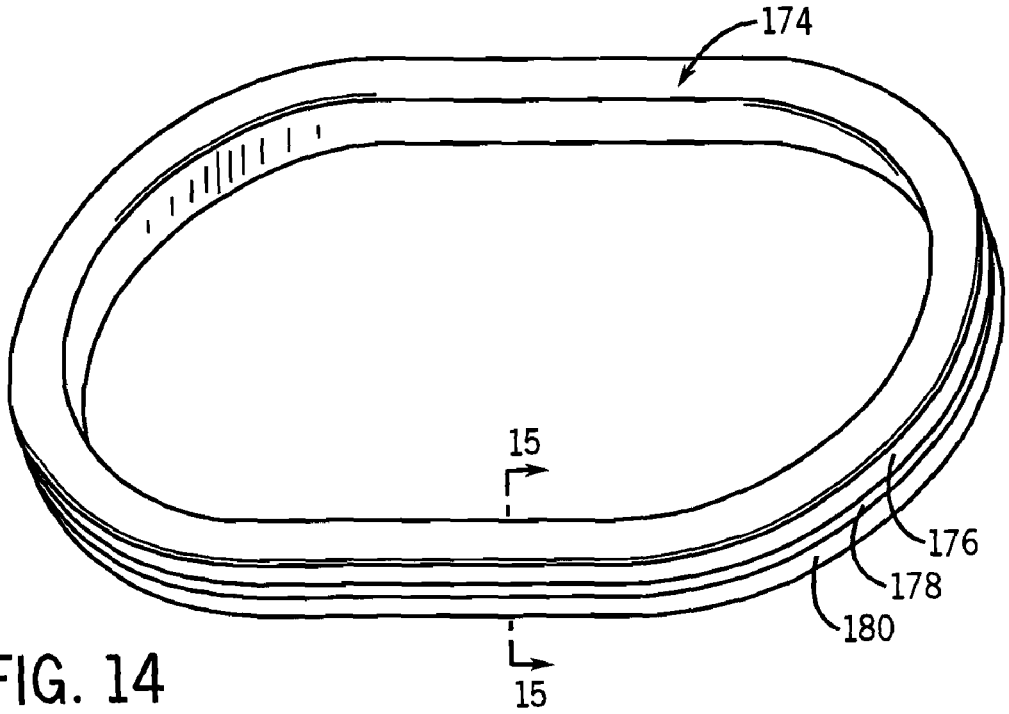

Opening 162, FIGS. 12, 13, has an inner perimeteral edge 164 facing laterally inwardly toward steering axis 74 and having distally opposite upper and lower surfaces 166 and 168. A pair of mounting plates are provided by upper and lower mounting plates 170 and 172, respectively, mounting marine propulsion device 54 to hull 24 at opening 162 formed through the top 40 of tunnel 38. A resiliently compressible elastomeric grommet 174, FIGS. 12-14, has a C-shape in cross-section, which C-shaped cross-section has first, second and third resiliently compressible segments 176, 178, 180, respectively. First segment 176 is compressed between and seals upper surface 166 of opening 162 to upper mounting plate 170. Second segment 178 is compressed between and seals inner perimeteral edge 164 of opening 162 to each of mounting plates 170 and 172. Third segment 180 is compressed between and seals lower surface 168 of opening 162 to lower mounting plate 172.

Upper mounting plate 170 has first and second sealing surfaces 184 and 186 respectively engaging the noted first and second segments 176 and 178 of grommet 174. Lower mounting plate 172 has third and fourth sealing surfaces 188 and 190 respectively engaging the noted second and third segments 178 and 180 of grommet 174. Second segment 178 of grommet 174 has an upper span 192 sealingly engaging upper mounting plate 170 at second sealing surface 186. Second segment 178 of grommet 174 has a lower span 194 sealingly engaging lower mounting plate 172 at third sealing surface 188.

Inner perimeteral edge 164 of opening 162 faces laterally radially inwardly along a first lateral plane 196, FIG. 13. First sealing surface 184 and first segment 176 of grommet 174 lie in a second lateral plane 198 parallel to first lateral plane 196 and spaced thereabove. Fourth sealing surface 190 and third segment 180 of grommet 174 lie in a third lateral plane 200 parallel to first lateral plane 196 and spaced therebelow.

Upper and lower mounting plates 170 and 172 are clamped to each other by bolts such as 202 at respective first and second facing surfaces 204 and 206, respectively. Upper mounting plate 170 has a first divergent surface 208 diverging upwardly from first facing surface 204. Lower mounting plate 172 has a second divergent surface 210 diverging downwardly from second facing surface 206. Second sealing surface 186 is constituted by at least a portion of first divergent surface 208. Third sealing surface 188 is constituted by at least a portion of second divergent surface 210.

First divergent surface 208 has an upper portion 212 extending upwardly to meet first sealing surface 184. First divergent surface 208 has a lower portion 214 extending downwardly from upper portion 212 to meet first facing surface 204. Second divergent surface 210 has a lower portion 216 extending downwardly to meet fourth sealing surface 190. Second divergent surface 210 has an upper portion 218 extending upwardly from lower portion 216 to meet second facing surface 206. Second sealing surface 186 extends along at least a portion of upper portion 212 of first divergent surface 208. Third sealing surface 188 extends along at least a portion of lower portion 216 of second divergent surface 210.

Figure 15:
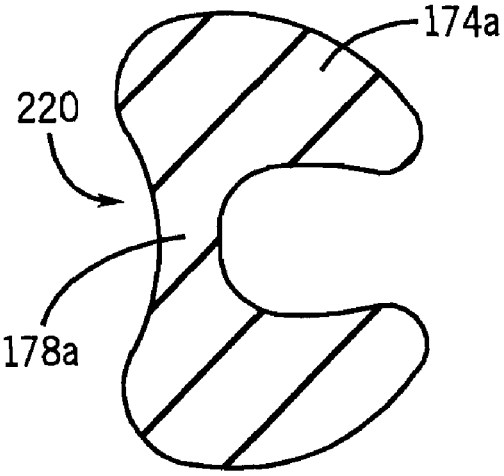
Figure 16:
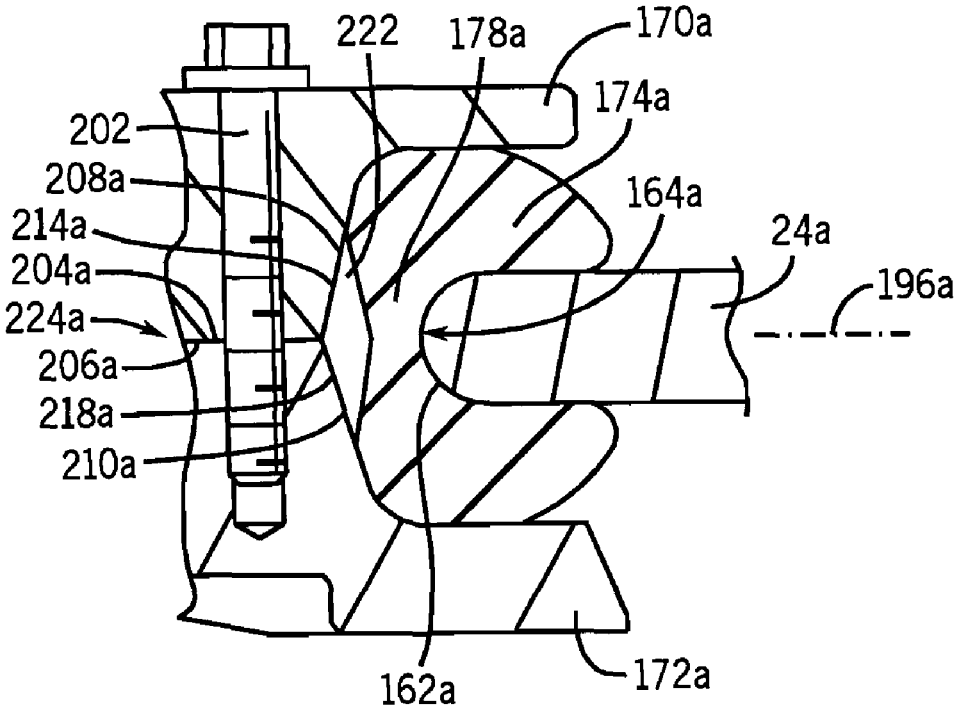
Figure 17:
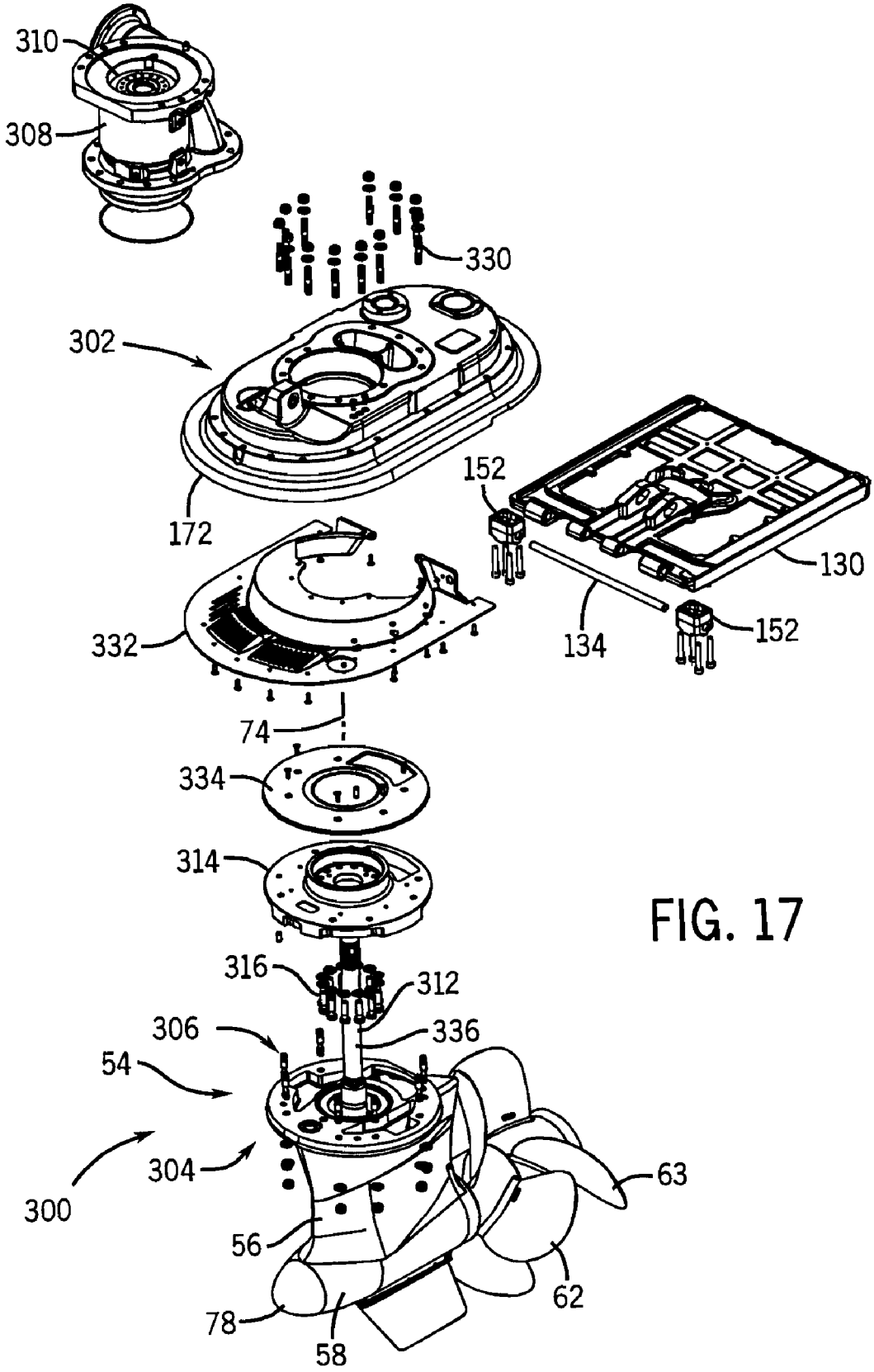
FIG. 17 is an exploded perspective view illustrating a marine drive in accordance with the present invention.
Figure 18:
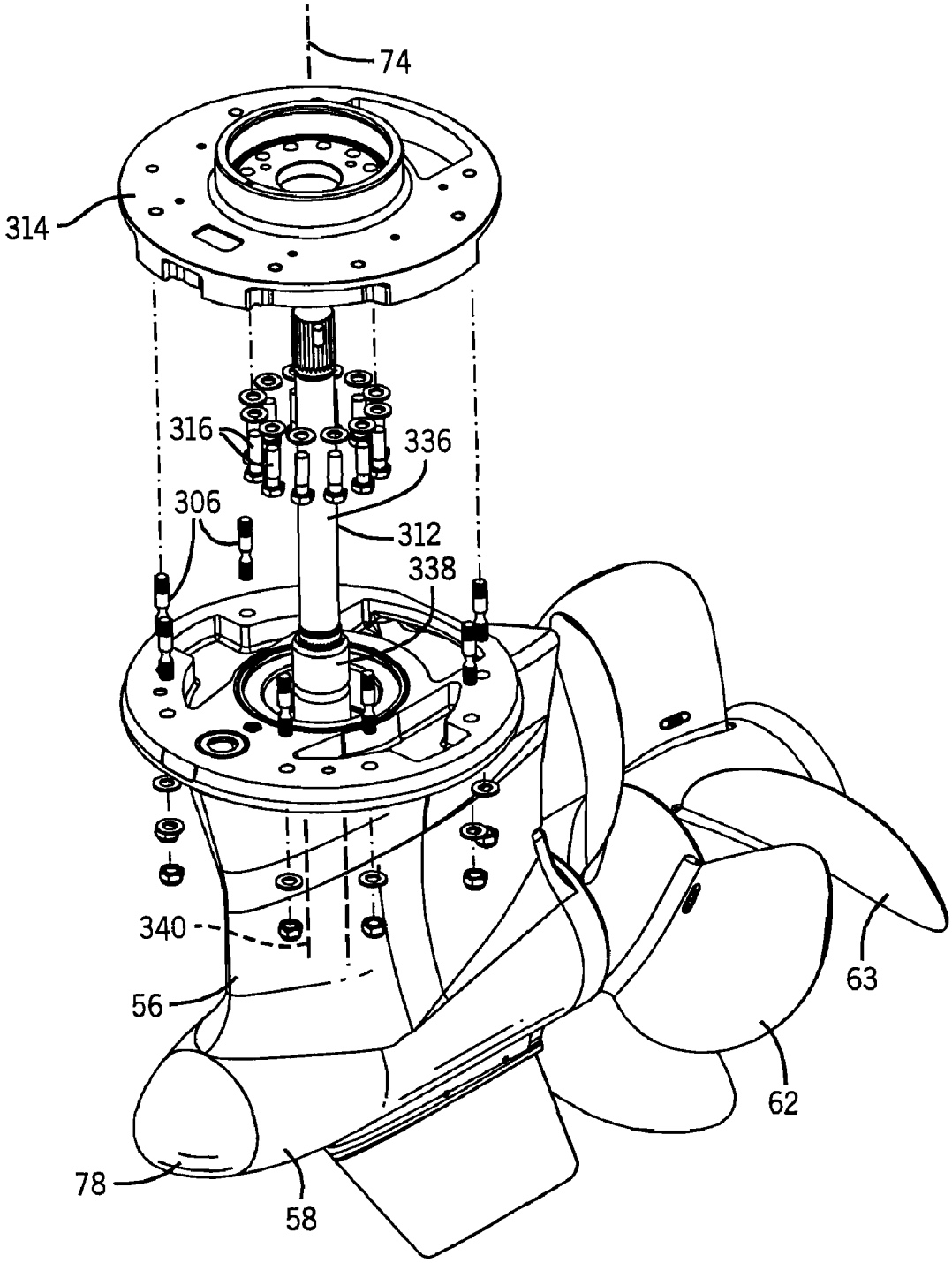
FIG. 18 is an enlarged view of a portion of FIG. 17.
Figure 19:
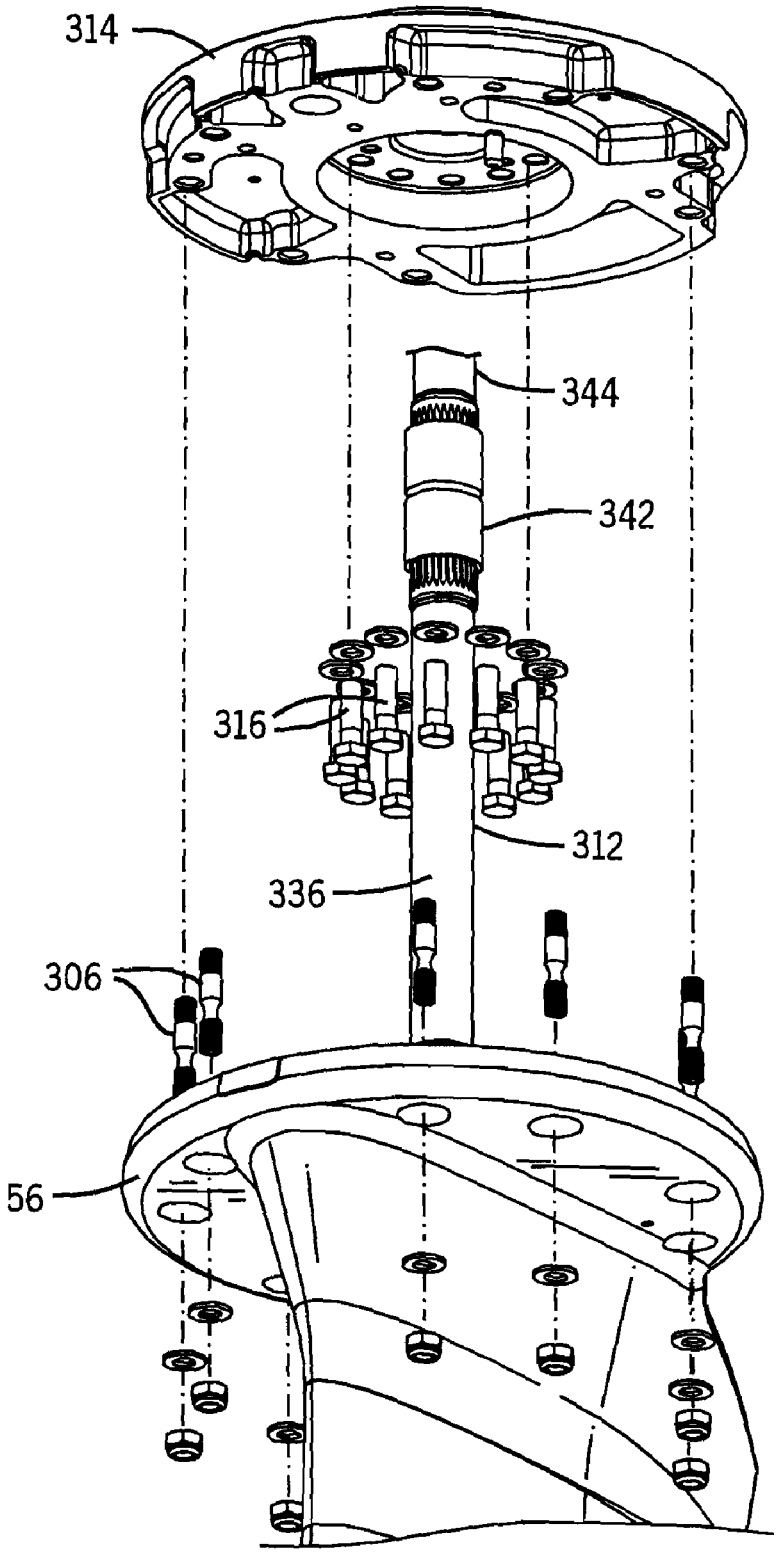
FIG. 19 is a perspective view from a different angle of a portion of FIG. 18.
Figure 20:
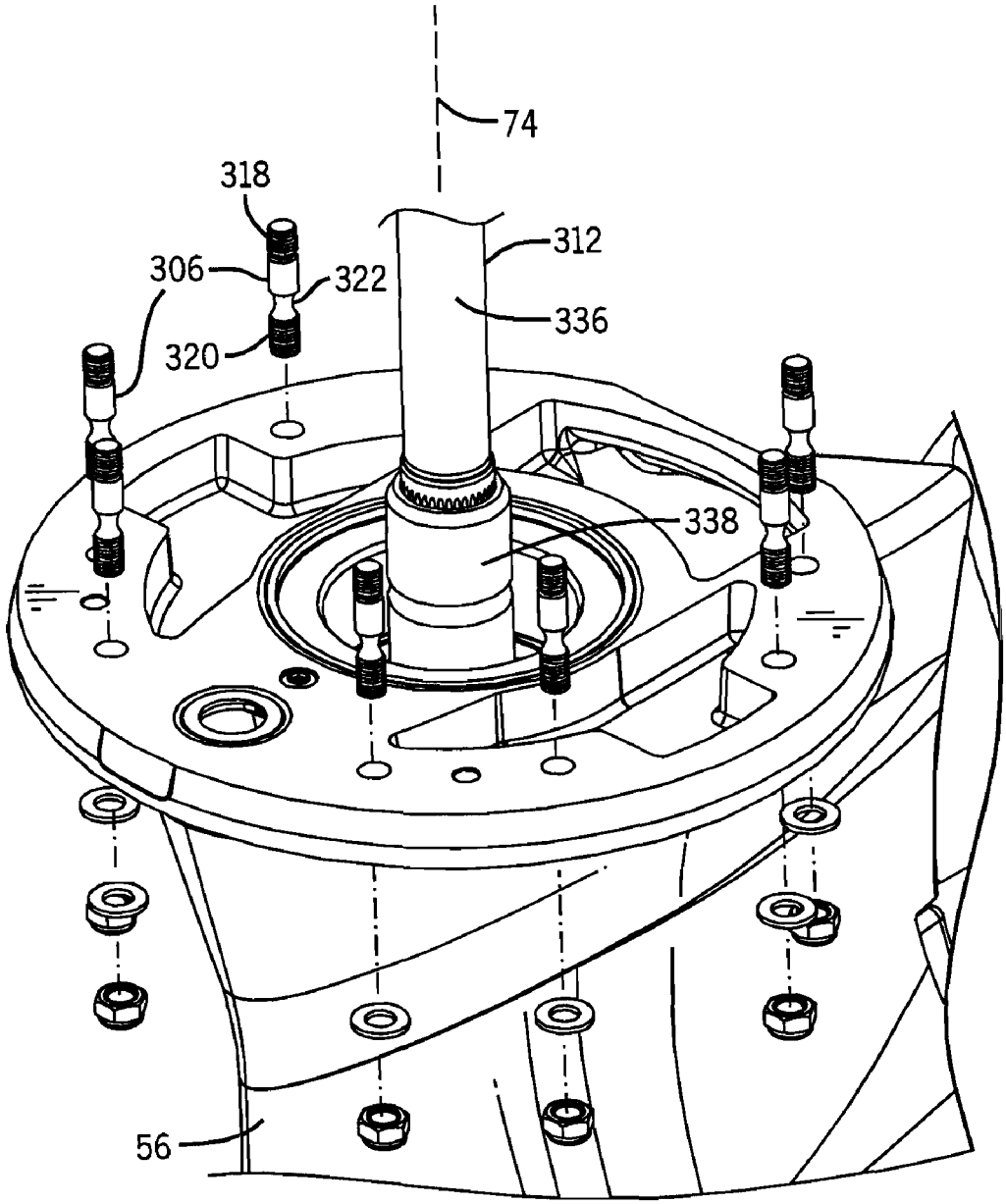
FIG. 20 is an enlarged view of a portion of FIG. 18.
Figure 21:
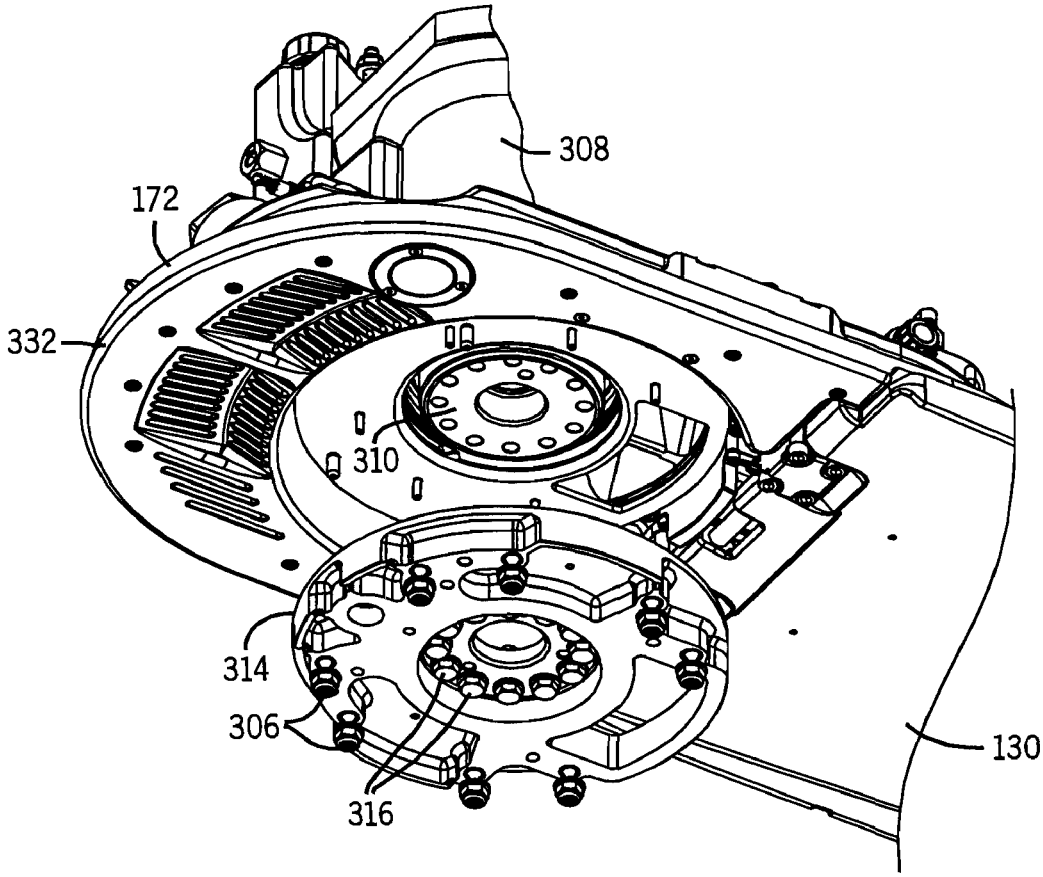
FIG. 21 is an enlarged view from a different perspective angle of a portion of FIG. 17 partially assembled.

FIGS. 15 and 16 show an alternate embodiment and use like reference numerals from above with a postscript "a" where appropriate to facilitate understanding. The embodiment of FIGS. 15, 16 is preferred where it is desired to permit excess bulging of the grommet into the gap between the mounting plates upon clamping of the mounting plates to each other, while still maintaining a tight flush fit of facing surfaces 204*a* and 206*a*, FIG. 16. Grommet 174*a*, FIG. 15, has an initial pre-compressed pre-clamped shape with a concave recess 220 at second segment 178*a*. In the clamped condition, FIG. 16, lower portion 214*a* of first divergent surface 208*a* and upper portion 218*a* of second divergent surface 210*a* are each laterally spaced from second segment 178*a* of grommet 174*a* by a gap 222 permitting excess bulging of grommet 174*a*, if needed, upon clamping of mounting plates 170*a* and 172*a* to each other. The grommet may bulge into gap 222 if needed, to assure a tight flush fit of facing surfaces 204*a* and 206*a* of facing surfaces of 204*a* and 206*a* against each other in abutting relation at junction 224, 224*a*. Inner perimeteral edge 164, 164*a* of opening 162, 162*a* faces laterally radially inwardly along lateral plane 196, 196*a*. Inner perimeteral edge 164, 164*a* and second segment 178, 178*a* of grommet 174, 174*a* and junction 224, 224*a* are co-planar along lateral plane 196, 196*a*.

Present Application

FIGS. 17-23 illustrate the present invention and use like reference numerals from above where appropriate to facilitate understanding.

FIGS. 17-23 show a marine drive 300 for propelling a marine vessel 22, including a marine propulsion device such as 54 extending from the vessel and having at lower gearcase 58 at least one water-engaging propulsor such as propeller 62, and in some embodiments a pair of counter-rotating propellers 62, 63, as noted above, and as is known, for propelling the vessel through a body of water. The marine drive has a first section 302 mounted to the vessel, for example by mounting plate 172 as above, and a second section 304 supporting the water-engaging propulsor 62, 63 for rotation. A break-away mount 306, to be described, mounts second section 304 to and supports second section 304 from first section 302 and breaks-away in response to a given underwater impact against second section 304 to protect first section 302 and vessel 22. Mounting plate 172 is mounted to the vessel as noted above, and supports a steering assembly, preferably hydraulic, supporting a steering kingpin 310 and a rotary driveshaft 312 for rotation about the noted steering axis 74. Second section 304 includes the noted driveshaft housing 56 receiving driveshaft 312, and having the noted gearcase 58 rotationally supporting propulsor 62, 63 and translating rotation of driveshaft 312 to rotation of propulsor 62, 63, as noted above. An adapter plate 314 mounts driveshaft housing 56 to steering kingpin 310, FIG. 21. Driveshaft housing 56 is mounted to adapter plate 314 at break-away mount 306, to be further described. In the preferred embodiment, a second break-away mount 316, FIGS. 17-19, 21, mounts adapter plate 314 to steering kingpin 310, to be described.

The noted first mount is provided by a first set of one or more threaded fasteners 306 (e.g. studs, bolts, etc.) of a first underwater impact strength or failure strength, and the noted second mount is provided by a second set of one or more threaded fasteners 316 of a second underwater impact strength or failure strength. The noted underwater impact strength is the impact load on the second section 304, e.g. at the gearcase, which causes the respective set of threaded fasteners, to be described, to fail, which is determined by factors including the tensile strength of the threaded fasteners, the number of threaded fasteners, the location, spacing and dimensions of the threaded fastener pattern. The first underwater impact strength is less than the second underwater impact strength. In one embodiment, threaded fasteners 306 of the first set are necked-down threaded studs, FIGS. 20, 22, 23, having a first threaded end 318 threadingly engaging adapter plate 314, a distally opposite second threaded end 320 threadingly engaging driveshaft housing 56, and an intermediate necked-down reduced outer diameter portion 322 between the first and second threaded ends 318 and 320 and fracturing in response to the noted given underwater impact. In one embodiment, threaded fasteners 316 of the second set are provided by threaded bolts engaging steering kingpin 310 and adapter plate 314. Various combinations of threaded fasteners, including studs and bolts, may be used.

Figure 22:
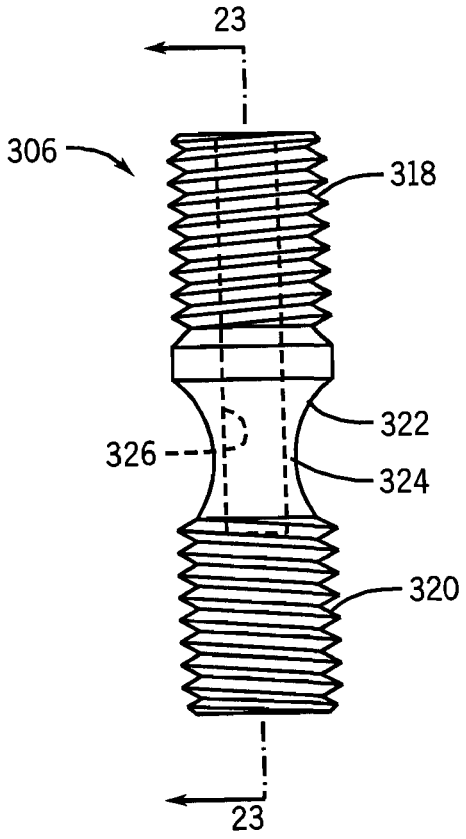
FIG. 22 is an enlarged view of a component of FIG. 17.
Figure 23:
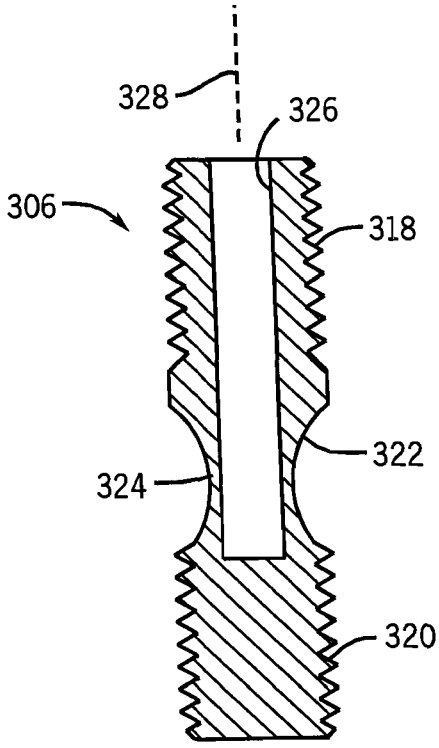
FIG. 23 is a sectional view taken along line 23-23 of FIG. 22.

Threaded fasteners 306 have a predetermined cross-sectional area 324, FIGS. 22, 23 at the noted intermediate necked-down reduced outer diameter portion 322 providing a given strength, including tensile strength, which is one of the determinative factors in the noted fracturing in response to the given underwater impact. In one embodiment, threaded fasteners 306 are hollowed-out, e.g. at blind bore 326 at intermediate necked-down reduced outer diameter portion 322 to maintain a desired cross-sectional area 324, namely in the form of an annulus, to maintain a given strength while concurrently providing an otherwise larger outer diameter at 322 to provide increased torsion strength for torquing the threaded fasteners to mount the first and second sections 302 and 304 for installation, e.g. for torquing first and second threaded ends 318 and 320 into the noted respective first and second sections 302 and 304, respectively, at adapter plate 314 and driveshaft housing 56, for installation. The otherwise larger outer diameter of intermediate necked-down reduced outer diameter portion 322 is less than the outer diameter of first and second ends 318 and 320 and greater than the outer diameter of a solid core intermediate necked-down reduced outer diameter portion, maintaining the noted given strength.

The necked-down feature at 322 provides a controlled failure location. When high strength material is used for threaded fastener 306, which is usually desirable, it has been found that the break-away fuse portion at 322 must be made very narrow (small outer diameter) because of such high strength material, in order to enable the desirable break-away fuse function. However, a very narrow (very small outer diameter) section at 322 cannot tolerate installation torque. Using a weaker constituent material for threaded fastener 306 is not desirable because such weaker material will be subject to excessive elongation, and hence the threaded fastener may stretch rather than break-away. To satisfy these design criteria, a hole or bore 326 is drilled or reamed axially at 328 into and/or through threaded fastener 306 including necked-down section 322. This enables section 322 to maintain a desired cross-sectional area (namely the area of annulus 324) while at the same time providing a larger outer diameter which is stronger in torsion, to tolerate installation torque, all while maintaining desired strength, including tensile strength. It is preferred that hole or bore 326 be relatively smooth along its interior wall surface to avoid stress concentrations that would cause a fatigue failure. The previous trade-off between failure strength for fracturing vs. torsion strength for installation torque is satisfied by enabling a reduced cross-sectional area at annulus 324 for desired failure strength, including tensile strength, and fracture while at the same time maintaining an increased outer diameter at 322 for torsion strength which can tolerate installation torque. The second set of threaded fasteners 316 are preferably solid core and without a necked-down reduced outer diameter portion, though these threaded fasteners may be necked-down and/or hollowed-out if desired, and it is preferred that they have a higher underwater impact strength or failure strength than threaded fasteners 306.

In the preferred embodiment, the noted first and second break-away mounts 306 and 316 mount the noted second section 304 to and support second section 304 from the noted first section 302 and break-away in stages in response to underwater impact against second section 304, e.g. at front nose 78 of torpedo-shaped lower gearcase 58, to protect first section 302 and vessel 22. The first break-away mount provided by threaded fasteners 306 breaks-away at a first underwater impact strength, and the second break-away mount provided by threaded fasteners 316 breaks-away at a second underwater impact strength. The noted first underwater impact strength is less than the noted second underwater impact strength. The first and second break-away mounts have differing first and second underwater impact or failure strengths, respectively, the first failure strength being less than the second failure strength. The first break-away mount is provided by the noted first set of a plurality of necked-down threaded fasteners 306 each having first and second distally opposite ends 318 and 320 and an intermediate necked-down reduced outer diameter portion 322 between the first and second ends 318 and 320 and fracturing in response to the noted first strength underwater impact. The second break-away mount is provided by the noted second set of a plurality of threaded fasteners 316. In one embodiment, the threaded fasteners 316 of the noted second set are without an intermediate necked-down reduced outer diameter portion. In the preferred embodiment, the threaded fasteners 306 of the noted first set are hollowed-out at 326 at intermediate necked-down reduced outer diameter portion 322, and threaded fasteners 316 of the noted second set have a solid core without being hollowed-out, though this combination may be varied as noted above. In the noted preferred embodiment, threaded fasteners 306 have a predetermined cross-sectional area 324 at intermediate necked-down reduced outer diameter portion 322 providing a given failure strength, including tensile strength, which is a factor in the noted fracturing in response to a given underwater impact. Threaded fasteners 306 are preferably hollowed-out at bore 326 at intermediate necked-down reduced outer diameter portion 322 to maintain a desired cross-sectional area at 324, namely in the form of an annulus, to maintain the noted given failure strength while concurrently providing an otherwise larger diameter to provide increased torsion strength for torquing the first and second threaded ends 318 and 320 into the noted first and second sections 302 and 304, respectively, for installation. The noted otherwise larger outer diameter of intermediate necked-down reduced outer diameter portion 322 is less than the outer diameter of the first and second threaded ends 318 and 320 and greater than the outer diameter of a solid core intermediate necked-down reduced outer diameter portion, maintaining the noted given underwater impact strength or failure strength.

The present system provides a method for assembling a marine drive 300 and protecting marine drive 300 for propelling a marine vessel 22, including a marine propulsion device extending from the vessel and having a water-engaging propulsor 62, 63 for propelling the vessel through a body of water. The method includes mounting the noted second section 304 to and supporting second section 304 from the noted first section 302 with a break-away mount 306 breaking-away in response to a given underwater impact against second section 304 to protect first section 302 and vessel 22. The method includes mounting first section 302 to second section 304 with a set of a plurality of necked-down threaded fasteners 306 having a first end 318 engaging first section 302, a distally opposite second end 320 engaging second section 304, and an intermediate necked-down reduced outer diameter portion 322 between the first and second ends 318 and 320 and fracturing in response to the given underwater impact. The method preferably includes mounting driveshaft housing 56 to adapter plate 314 with the set of the plurality of necked-down threaded fasteners 306, and mounting adapter plate 314 to steering kingpin 310 with a second set of threaded fasteners 316. The method further includes hollowing-out the first set of necked-down threaded fasteners 306 at bore 326 into intermediate necked-down reduced outer diameter portion 322, and providing threaded fasteners 316 with a solid core without hollowing-out. Mounting plate 172 is preferably mounted to the vessel as above upon clamping of mounting plates 170 and 172 to each other. Steering assembly 308 is mounted to mounting plate 172 at bolts 330. Trim tab 130 is mounted to the mounting plate as above, for example at hinges 152 for pivoting about pivot axis 134. A plastic shroud 332 may be mounted to the underside of mounting plate 172, and a plastic wear plate 334 may be mounted between shroud 332 and adapter plate 314. Driveshaft 312 is preferably provided by a multi-part driveshaft having an intermediate segment 336 having a lower splined end coupled at coupler 338 to a lower driveshaft segment 340 extending into driveshaft housing 56, and having an upper splined end coupled at coupler 342 to an upper driveshaft segment 344 extending upwardly into steering kingpin 310. Upon break-away, the driveshaft segments typically de-couple at upper coupler 342.

In the noted marine drive and marine vessel and drive combination, it is desirable to have high strength material for the break-away mount or fuse such as 306 so that it cannot be replaced in the field with a significantly stronger fastener which in turn may defeat the desired break-away function. It is also desirable that the yield strength be close to the ultimate strength, to reduce the likelihood of stretched fasteners that don't fracture. As material strength increases, the diameter of the necked-down portion 322 decreases. As such neck diameter decreases, the torsional strength is reduced, which in turn limits the installation torque that can be applied to the fastener 306, which in turn may cause under-torquing, or over-torquing and failure of the fastener during installation. One embodiment of the present system provides a solution to the noted torsional failures by incorporating axial bore or hole 326 through the neck area at 322 so that a desired cross-sectional area 324 can be maintained at a desired minimum, while also enabling a larger outside diameter to handle torsional loads. This is effective because the material in the center of the fastener 306 is not useful for resisting torsion or reducing torsional stresses.

In one embodiment, first section 302 is mounted to second section 304 at a bolted or otherwise fastened joint to provide mounted sections thereat and to prevent fatigue failure from operating loads, including propulsor thrust and steering loads. The noted break-away mount is provided at the fastened joint and includes a set of one or more fasteners 306 pre-tensioned to a load which prevents separation of the mounted sections 302 and 304 in response to operating loads. Accordingly, alternating loads due to application and release of operating loads are carried by the mounted sections and not by the threaded fasteners 306. This in turn enables reduced failure strength of threaded fasteners 306 and increased protection of first section 302 and vessel 22. Fasteners 306 have lower failure strength than a break-away attachment that is not incorporated into the fastened joint and is limited by fatigue and must otherwise be designed with increased failure strength such that operating loads are below that which would cause fatigue failure of such break-away attachment, which in turn would reduce protection of first section 302 and vessel 22. The underwater impact strength or failure strength is the ability of the joint to resist a combination of shear and moment when an object is contacted some distance below the joint. In one preferred embodiment, eight 7.5 mm diameter necked-down hollow studs 306 are provided on a bolt circle about 12 inches in diameter to provide the first break-away mount 306, and the second break-away mount 316 is provided by twelve bolts, each 12 mm diameter, on a smaller diameter bolt circle but having greater impact strength.

In one embodiment, second break-away mount 316 breaks-away if, and in some embodiments only if, the first break-away mount 306 is disabled, e.g. by replacement of the first set of threaded fasteners 306 with higher strength threaded fasteners.

In one embodiment, adapter plate 314 is mounted between the noted first and second sections 302 and 304. The first break-away mount is provided by the noted first set of one or more threaded fasteners 306 of a first failure strength or underwater impact strength mounting second section 304 to adapter plate 314. The second break-away mount is provided by a second set of one or more threaded fasteners 316 of a second failure strength or underwater impact strength mounting adapter plate 314 to the first section 302. The fasteners are selected such that the first failure strength is less than the second failure strength.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

What is claimed is:

1. A marine drive for propelling a marine vessel, including a marine propulsion device extending from said vessel and having a water-engaging propulsor for propelling said vessel through a body of water, said marine drive comprising a first section mounted to said vessel, a second section supporting said water-engaging propulsor for rotation, and a break-away mount mounting said second section to and supporting said second section from said first section and breaking-away in response to a given underwater impact against said second section to protect said first section and said vessel, wherein said first section comprises a mounting plate mounted to said vessel and supporting a steering assembly supporting a steering kingpin and a rotary driveshaft, and said second section comprises a driveshaft housing receiving said driveshaft and having a gearcase rotationally supporting said propulsor and translating rotation of said driveshaft to rotation of said propulsor, and an adapter plate mounting said driveshaft housing to said steering kingpin, and wherein said driveshaft housing is mounted to said adapter plate at said break-away mount.

2. The marine drive according to claim 1 comprising a second break-away mount mounting said adapter plate to said steering kingpin.

3. The marine drive according to claim 2 wherein said first break-away mount comprises a first set of one or more threaded fasteners of a first underwater impact strength, and said second break-away mount comprises a second set of one or more threaded fasteners of a second underwater impact strength, and wherein said first underwater impact strength is less than said second underwater impact strength.

4. The marine drive according to claim 3 wherein said threaded fasteners of said first set comprise necked-down threaded fasteners having a first end engaging said adapter plate, a distally opposite second end engaging said driveshaft housing, and an intermediate necked-down reduced outer diameter portion between said first and second ends and fracturing in response to said given underwater impact.

5. The marine drive according to claim 4 wherein said threaded fasteners of said second set engage said steering kingpin and said adapter plate.

6. The marine drive according to claim 3 wherein said threaded fasteners of said first set comprise necked-down threaded fasteners having a first threaded end threadingly engaging said adapter plate, a distally opposite second threaded end threadingly engaging said driveshaft housing, and an intermediate necked-down reduced outer diameter portion between said first and second threaded ends and fracturing in response to said given underwater impact, and wherein said threaded fasteners of said second set comprise threaded bolts engaging said steering kingpin and said adapter plate.

7. A marine drive for propelling a marine vessel, including a marine propulsion device extending from said vessel and having a water-engaging propulsor for propelling said vessel through a body of water, said marine drive comprising a first section mounted to said vessel, a second section supporting said water-engaging propulsor for rotation, and a break-away mount mounting said second section to and supporting said second section from said first section and breaking-away in response to a given underwater impact against said second section to protect said first section and said vessel, wherein said break-away mount comprises a set of a plurality of necked-down threaded fasteners each having first and second distally opposite ends and an intermediate necked-down reduced outer diameter portion between said first and second ends and fracturing in response to said given underwater impact.

8. A marine drive for propelling a marine vessel, including a marine propulsion device extending from said vessel and having a water-engaging propulsor for propelling said vessel through a body of water, said marine drive comprising a first section mounted to said vessel, a second section supporting said water-engaging propulsor for rotation, and a break-away mount mounting said second section to and supporting said second section from said first section and breaking-away in response to a given underwater impact against said second section to protect said first section and said vessel, wherein said first section is mounted to said second section at a fastened joint to provide mounted sections thereat and to prevent fatigue failure from operating loads, including propulsor thrust and steering loads, said break-away mount being at said fastened joint and comprising a set of one or more threaded fasteners pre-tensioned to a load which prevents separation of said mounted sections in response to said operating loads, whereby alternating loads due to application and release of said operating loads are carried by said mounted sections and not by said threaded fasteners, to enable reduced underwater impact strength of said threaded fasteners and increased protection of said first section and said vessel.

9. The marine drive according to claim 8 wherein said threaded fasteners have lower underwater impact strength than a break-away attachment that is not incorporated into said fastened joint and is limited by fatigue and must otherwise be designed with increased failure strength such that said operating loads are below that which would cause fatigue failure of said break-away attachment, which in turn reduces protection of said first section and said vessel.

10. A marine drive for propelling a marine vessel, including a marine propulsion device extending from said vessel and having a water-engaging propulsor for propelling said vessel through a body of water, said marine drive comprising a first section mounted to said vessel, a second section supporting said water-engaging propulsor for rotation, and first and second break-away mounts mounting said second section to and supporting said second section from said first section and breaking-away in stages in response to underwater impact against said second section to protect said first section and said vessel, wherein said first break-away mount breaks-away at a first underwater impact strength, and said second break-away mount breaks-away at a second underwater impact strength, said first underwater impact strength being less than said second underwater impact strength.

11. The marine drive according to claim 10 wherein said second break-away mount breaks-away if said first break-away mount is disabled.

12. The marine drive according to claim 11 wherein said first break-away mount comprises a first set of one or more threaded fasteners of a first underwater impact strength, and said second break-away mount comprises a second set of one or more threaded fasteners of a second underwater impact strength, wherein said first underwater impact strength is less than said second underwater impact strength, and wherein said second break-away mount breaks-away if said first break-away mount is disabled by replacement of said first set of threaded fasteners with higher strength threaded fasteners.

13. The marine drive according to claim 10 comprising an adapter plate mounted between said first and second sections, and wherein said first break-away mount comprises a first set of one or more threaded fasteners of a first underwater impact strength mounting said second section to said adapter plate, and said second break-away mount comprises a second set of one or more threaded fasteners of a second underwater impact strength mounting said adapter plate to said first section, said first underwater impact strength being less than said second underwater impact strength.

14. The marine drive according to claim 10 wherein in combination:

said first break-away mount comprises a first set of a plurality of necked-down threaded fasteners each having first and second distally opposite ends and an intermediate necked-down reduced outer diameter portion between said first and second ends and fracturing in response to said first strength underwater impact;

said second break-away mount comprises a second set of a plurality of threaded fasteners.

15. The marine drive according to claim 14 wherein said threaded fasteners of said second set are without an intermediate necked-down reduced outer diameter portion.

16. A marine drive for propelling a marine vessel, including a marine propulsion device extending from said vessel and having a water-engaging propulsor for propelling said vessel through a body of water, said marine drive comprising a first section mounted to said vessel and comprising a mounting plate mounted to said vessel and supporting a steering assembly supporting a steering kingpin and a rotary driveshaft, a second section supporting said water-engaging propulsor for rotation and comprising a driveshaft housing receiving said driveshaft and having a gearcase rotationally supporting said propulsor and translating rotation of said driveshaft to rotation of said propulsor, and an adapter plate mounting said driveshaft housing to said steering kingpin, a break-away mount mounting said driveshaft housing to said adapter plate and breaking-away in response to a given underwater impact against said second section to protect said first section and said vessel, said break-away mount comprising a set of a plurality of necked-down threaded fasteners having a first end engaging said adapter plate, a distally opposite second end engaging said driveshaft housing, and an intermediate necked-down reduced outer diameter portion between said first and second ends and fracturing in response to said given underwater impact.

17. A method for assembling a marine drive and protecting a marine drive for propelling a marine vessel, including a marine propulsion device extending from said vessel and having a water-engaging propulsor for propelling said vessel through a body of water, said marine drive comprising a first section mounted to said vessel, and a second section supporting said water-engaging propulsor for rotation, said method comprising mounting said second section to and supporting said second section from said first section with a break-away mount breaking-away in response to a given underwater impact against said second section to protect said first section and said vessel, and comprising mounting said first section to said second section at a fastened joint to provide mounted sections thereat, to prevent fatigue failure from operating loads, including propulsor thrust and steering loads, providing said break-away mount at said fastened joint by a set of one or more threaded fasteners, and pre-tensioning said threaded fasteners to a load which prevents separation of said mounted sections in response to said operating loads, whereby alternating loads due to application and release of said operating loads are carried by said mounted sections and not by said threaded fasteners, to enable reduced underwater impact strength of said threaded fasteners and increased protection of said first section and said vessel.

18. The method according to claim 17 comprising providing said threaded fasteners of lower underwater impact strength than a break-away attachment that is not incorporated into said fastened joint and is limited by fatigue and must otherwise be designed with increased underwater impact strength such that said operating loads are below that which would cause fatigue failure of said break-away attachment, which in turn reduces protection of said first section and said vessel.

19. A method for assembling a marine drive and protecting a marine drive for propelling a marine vessel, including a marine propulsion device extending from said vessel and having a water-engaging propulsor for propelling said vessel through a body of water, said marine drive comprising a first section mounted to said vessel, and a second section supporting said water-engaging propulsor for rotation, said method comprising mounting said second section to and supporting said second section from said first section with a break-away mount breaking-away in response to a given underwater impact against said second section to protect said first section and said vessel, and comprising mounting said first section to said second section with a set of a plurality of necked-down threaded fasteners having a first end engaging said first section, a distally opposite second end engaging said second section, and an intermediate necked-down reduced outer diameter portion between said first and second ends and fracturing in response to said given underwater impact.

20. The method according to claim 19 comprising providing said first section with a base plate mounted to said vessel and supporting a steering assembly supporting a steering kingpin and a rotary driveshaft, providing said second section with a driveshaft housing receiving said driveshaft and having a gearcase rotationally supporting said propulsor and translating rotation of said driveshaft to rotation of said propulsor, and an adapter plate mounting said driveshaft housing to said steering kingpin, said method further comprising mounting said driveshaft housing to said adapter plate with said set of said plurality of necked-down threaded fasteners, and mounting said adapter plate to said steering kingpin with a second set of threaded fasteners.

21. A method for assembling a marine drive and protecting a marine drive for propelling a marine vessel, including a marine propulsion device extending from said vessel and having a water-engaging propulsor for propelling said vessel through a body of water, said marine drive comprising a first section mounted to said vessel, and a second section supporting said water-engaging propulsor for rotation, said method comprising mounting said second section to and supporting said second section from said first section with a break-away mount breaking-away in response to a given underwater impact against said second section to protect said first section and said vessel, and comprising mounting an adapter plate between said first and second sections, providing said first break-away mount with a first set of one or more threaded fasteners of a first underwater impact strength, providing said second break-away mount with a second set of one or more threaded fasteners of a second underwater impact strength, mounting said adapter plate to said first section with said second set of threaded fasteners, mounting said second section to said adapter plate with said first set of threaded fasteners, selecting said first and second sets of threaded fasteners such that said first underwater impact strength is less than said second underwater impact strength.

* * * * *